US008323094B2

(12) United States Patent
Palermo et al.

(10) Patent No.: US 8,323,094 B2
(45) Date of Patent: Dec. 4, 2012

(54) AWARDING ACHIEVEMENTS IN WAGERING GAMES

(75) Inventors: James Palermo, Chicago, IL (US); Jamie W. Vann, Chicago, IL (US)

(73) Assignee: WMS Gaming, Inc., Waukegan, IL (US)

( * ) Notice: Subject to any disclaimer, the term of this patent is extended or adjusted under 35 U.S.C. 154(b) by 0 days.

(21) Appl. No.: 13/380,439

(22) PCT Filed: Jun. 22, 2010

(86) PCT No.: PCT/US2010/039518

§ 371 (c)(1),
(2), (4) Date: Jan. 20, 2012

(87) PCT Pub. No.: WO2010/151547

PCT Pub. Date: Dec. 29, 2010

(65) Prior Publication Data

US 2012/0115591 A1 May 10, 2012

Related U.S. Application Data

(60) Provisional application No. 61/219,566, filed on Jun. 23, 2009.

(51) Int. Cl.
*A63F 9/24* (2006.01)

(52) U.S. Cl. ..... 463/20; 463/16; 463/25

(58) Field of Classification Search ..... 463/16
See application file for complete search history.

(56) References Cited

U.S. PATENT DOCUMENTS 5,996,997 A * 12/1999 Kamille ..... 273/139
2002/0055381 A1* 5/2002 Tarantino ..... 463/20
2002/0090987 A1 7/2002 Walker et al.
2003/0073477 A1* 4/2003 Baerlocher et al. ..... 463/16
2005/0233794 A1 10/2005 Cannon et al.
2006/0194633 A1 8/2006 Paulsen

FOREIGN PATENT DOCUMENTS

EP 1266677 12/2002
WO WO2008048634 4/2008
WO WO2010151547 12/2010

OTHER PUBLICATIONS

"PCT Application No. PCT/US10/39518 International Preliminary Report on Patentability", Sep. 27, 2011 , 15 pages.
"PCT Application No. PCT/US10/39518 International Search Report", Aug. 30, 2010 , 10 pages.

* cited by examiner

*Primary Examiner* — Omkar Deodhar
(74) *Attorney, Agent, or Firm* — Delizio Gilliam, PLLC

(57) ABSTRACT

A wagering game system and its operations are described herein. In embodiments, the operations can include determining possible wagering game events that can occur for a wagering game. The operations can further include determining a subset of the possible wagering game events and configuring an award ladder game to award prizes in a stair-step fashion based on occurrence of the subset of possible wagering game events. The operations can further include ordering a plurality of awards, or prizes, on an award ladder in an order of value and configuring the award ladder to award the plurality of awards in a sequential order of value according to an order of occurrence of the subset of possible wagering game events. The operations can further include configuring the award ladder to reset when the plurality of awards have been awarded.

25 Claims, 11 Drawing Sheets

AWARDING ACHIEVEMENTS IN WAGERING GAMES

RELATED APPLICATIONS

This application claims the priority benefit of U.S. Provisional Application Ser. No. 61/219,566 filed Jun. 23, 2009.

LIMITED COPYRIGHT WAIVER

A portion of the disclosure of this patent document contains material that is subject to copyright protection. The copyright owner has no objection to the facsimile reproduction by anyone of the patent disclosure, as it appears in the Patent and Trademark Office patent files or records, but otherwise reserves all copyright rights whatsoever. Copyright 2010, WMS Gaming, Inc.

TECHNICAL FIELD

Embodiments of the inventive subject matter relate generally to wagering game systems and networks that, more particularly, award achievements in wagering games.

BACKGROUND

Wagering game machines, such as slot machines, video poker machines and the like, have been a cornerstone of the gaming industry for several years. Generally, the popularity of such machines depends on the likelihood (or perceived likelihood) of winning money at the machine and the intrinsic entertainment value of the machine relative to other available gaming options. Where the available gaming options include a number of competing wagering game machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for wagering game machine manufacturers to continuously develop new games and gaming enhancements that will attract frequent play.

SUMMARY

In some embodiments, a method comprises determining a plurality of possible wagering game events from one or more wagering games; determining a subset of game events from the plurality of possible wagering game events; displaying an award ladder on a wagering game machine display, via at least one processor, wherein the award ladder is associated with the one or more wagering games, and wherein the award ladder includes a plurality of awards having varying values; ordering the plurality of awards on the award ladder in a sequential order of value; and configuring the award ladder to award the plurality of awards in the sequential order of value in an order of occurrence of the subset of game events.

In some embodiments, the plurality of possible wagering game events comprises occurrences in the one or more wagering games of one or more of arrangements of wagering game playing elements, appearances of specific items, and sequences of events.

In some embodiments, the method further comprises determining an achievement list that includes a listing of the subset of game events; associating the achievement list with the award ladder; and configuring the achievement list to indicate achievement of any of the subset of game events.

In some embodiments, the method further comprises determining an odds list that includes a listing of frequency of occurrence for the subset of game events; and associating the odds list with the achievement list.

In some embodiments, a number of the plurality of awards correlates with a number of the subset of game events, and further comprises: configuring the award ladder to determine the timing of the order of occurrence of the subset of game events; and configuring the award ladder to award a lowest-valued, unawarded award on the award ladder based on the timing of the order of occurrence of the subset of game events.

In some embodiments, the method further comprises: determining player preferences for award types; and determining the plurality of awards based on the award types.

In some embodiments, ordering the plurality of awards on the award ladder in a sequential order of value comprises: determining player preference ratings for the award types, and ordering the awards on the award ladder based on the player preference ratings.

In some embodiments, the method further comprises configuring the award ladder to reset when the plurality of awards have been awarded.

In some embodiments, one or more machine-readable storage media having instructions stored thereon, which when executed by a set of one or more processors causes the set of one or more processors to perform operations comprising: determining a secondary game event list, wherein the secondary game event list includes a plurality of subset game events from a subset of a plurality of possible primary wagering game events from primary wagering games playable on a wagering game machine; determining an award ladder associated with a secondary game, wherein the award ladder includes a plurality of awards in a sequential order of value; presenting the award ladder on the wagering game machine; determining playing activity for a player account on at least one primary wagering games that the player plays on the wagering game machine; determining an occurrence of at least one of the plurality of subset game events during the playing activity of the at least one of the primary wagering games; determining that the at least one of the plurality of subset game events is eligible for an award; determining one eligible award on the award ladder that is next is sequence of the sequential order of value; and awarding at least a portion of the one eligible award to the player account.

In some embodiments, the operation of determining that the at least one of the plurality of subset game events is eligible for an award further comprises: determining that the at least one of the plurality of subset game events has not already occurred for the secondary game.

In some embodiments, the operations further comprise indicating achievement of the one eligible award on the award ladder.

In some embodiments, a value for the one eligible award is independent of a frequency of occurrence for the at least one of the plurality of subset game events.

In some embodiments, said operation of determining one eligible award on the award ladder that is next is sequence of the sequential order of value includes operations comprising: determining an ascending order of value for the plurality of awards on the award ladder; determining a lowest-valued unawarded award on the ascending order of value; and using the lowest-valued unawarded award as the one eligible award on the award ladder that is next is sequence of the sequential order of value.

In some embodiments, the operation of awarding the at least a portion of the one eligible award to the player account comprises: determining multiple player accounts that are teamed together for dividing awards for wagering games, wherein the player account is one of the multiple player accounts, determining an award division setting for the multiple player accounts, wherein the award division setting specifies a division of possession rights to the one eligible award, and dividing the one eligible award according to the award division setting.

In some embodiments, the operations further comprise: requiring an intermediate activity to receive the award.

In some embodiments, a system comprises: a client that comprises a wagering game module configured to present a wagering game, wherein the wagering game includes a plurality of possible wagering game events. The wagering game module can be further configured to present an award ladder game associated with the wagering game; The system can also comprise a wagering game server that includes a secondary game controller configured to determine award ladder game events for the award ladder game, wherein the award ladder game events are a subset of the plurality of possible wagering game events. The wagering game server can also be configured to determine the award ladder associated with the award ladder game wherein the award ladder includes a plurality of awards in a sequential order of value, determine playing activity on the wagering game, determine an occurrence of one wagering game event that correlates with one award ladder game event during the playing activity of the wagering game, determine that the one award ladder game events is eligible for an award, determine one eligible award on the award ladder that is next is sequence of the sequential order of value, and award at least a portion of the one eligible award.

In some embodiments, the one eligible award is a lowest-valued, unawarded award from the award ladder.

In some embodiments, a value for the one eligible award is independent of a frequency of occurrence for the one wagering game event.

In some embodiments, the wagering game server further comprises: an account manager configured to interact with a player account, wherein the player account performs the playing activity of the wagering game, wherein the player account includes one or more settings that specify one or more preferences for awards; and a secondary game configuration module configured to customize the award ladder according to the one or more preferences for awards.

In some embodiments, an apparatus comprises a wagering game module configured to determine playing activity in a primary wagering game, determine that the primary wagering game is associated with a secondary game, determine triggers for winning an award in the secondary game, wherein the triggers for winning the award result from the playing activity in a primary wagering game, determine a plurality of prizes associated with the secondary game, wherein the plurality of prizes are in a sequential order of value, determine that the playing activity generates a trigger to win at least one of the plurality of prizes in the secondary game, determine an eligible prize that is next is sequence of unawarded prizes on the sequential order of value, and present a secondary game activity for a player account to perform to win at least a portion of the eligible prize.

In some embodiments, the primary wagering game includes game settings, and wherein the secondary game activity is related to the game settings.

In some embodiments, the wagering game module is further configured to generate a picker-grid that includes a number of picking items, wherein the number of picking items correlates with one or more betting settings of the primary wagering game, present the picker-grid as the secondary game activity, determine one or more winning selections of picking items that reveal the at least a portion of the eligible prize, and provide the at least a portion of the eligible prize to the player account.

In some embodiments, an apparatus comprises means for presenting a wagering game that utilizes a plurality of possible configurations of wagering game playing elements to present game results of playing activity; means for determining an achievement list for a bonus game associated with the wagering game, wherein the achievement list includes a subset of eligible configurations from the plurality of possible configurations of wagering game playing elements; means for determining an award list associated with the bonus game, wherein the award list includes a plurality of prizes in a sequential order of value; means for determining an occurrence, during the playing activity of the wagering game, of at least one eligible configuration of playing elements that is listed on the achievement list; means for determining that the at least one eligible configuration on the achievement list has not already been achieved for a current playing cycle of the bonus game; means for determining one unawarded prize on the award list that is next is sequence of the sequential order of value; and means for awarding at least a portion of the one unawarded prize to the player account.

In some embodiments, the apparatus further comprises means for determining a group to which the player account belongs; means for determining award division settings for the group, wherein the award division settings specify a division of possession rights to the unawarded prize; and means for dividing the at least a portion of the one unawarded prize according to the award division settings.

In some embodiments, the apparatus further comprises means for determining that the at least one eligible configuration is also an awardable event for a group scavenger hunt game; and means for awarding a group game scavenger hunt achievement.

BRIEF DESCRIPTION OF THE DRAWING(S)

Embodiments are illustrated in the Figures of the accompanying drawings in which.

DESCRIPTION OF ILLUSTRATIVE EMBODIMENTS

This description of the embodiments is divided into six sections. The first section provides an introduction to embodiments. The second section describes example operating environments while the third section describes example operations performed by some embodiments. The fourth section describes additional example embodiments while the fifth section describes additional example operating environments. The sixth section presents some general comments.

Introduction

This section provides an introduction to some embodiments.

Wagering games are expanding in popularity. Wagering game enthusiasts expect continuous innovations to the wagering game experience. As stated previously, wagering game companies are interested in creating and providing innovate wagering games and gaming features to the demanding public. Some embodiments of the present subject matter describe examples of awarding achievements in wagering games. Embodiments can be presented over any type of communications network (e.g., public or private) that provides access to wagering games, such as a website (e.g., via wide-area-networks, or WANs), a private gaming network (e.g., local-area-networks, or LANs), a file sharing networks, a social network, etc., or any combination of networks. Multiple users can be connected to the networks via computing devices. The multiple users can have accounts that subscribe to specific services, such as account-based wagering systems (e.g., account-based wagering game websites, account-based casino networks, etc.).

In some embodiments herein a user may be referred to as a player (i.e., of wagering games), and a player may be referred to interchangeably as a player account. Account-based wagering systems utilize player accounts when transacting and performing activities, at the computer level, that are initiated by players. Therefore, a "player account" represents the player at a computerized level. The player account can perform actions via computerized instructions. For example, in some embodiments, a player account may be referred to as performing an action, controlling an item, communicating information, etc. Although a player, or person, may be activating a game control or device to perform the action, control the item, communicate the information, etc., the player account, at the computer level, can be associated with the player, and therefore any actions associated with the player can also be associated with the player account. Therefore, for brevity, to avoid having to describe the interconnection between player and player account in every instance, a "player account" may be referred to herein in either context. Further, in some embodiments herein, the word "gaming" is used interchangeably with "gambling".

Figure 1:
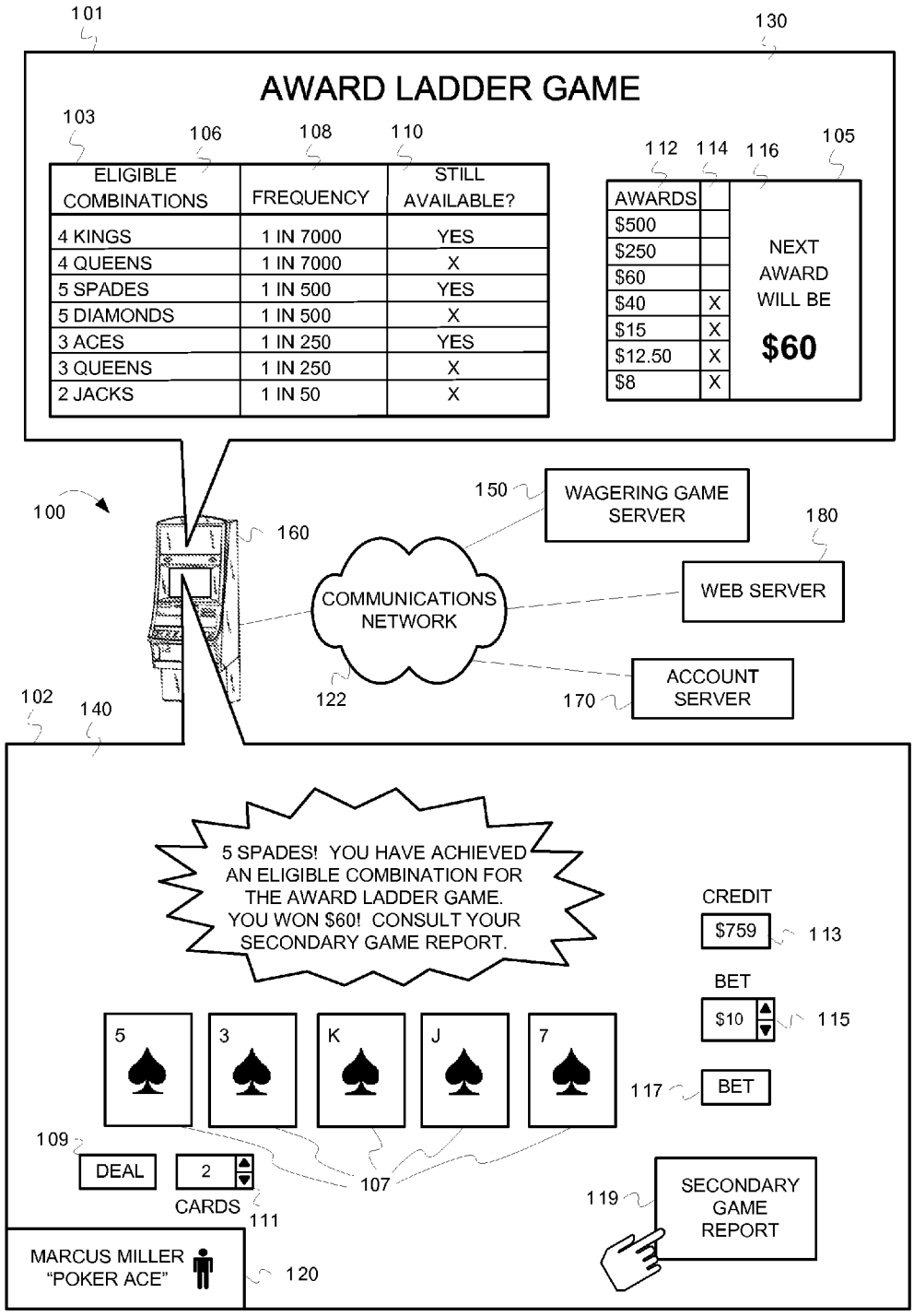
FIG. 1 is an illustration of presenting and controlling award ladder games, according to some embodiments.

FIG. 1 is a conceptual diagram that illustrates an example of presenting and controlling award ladder games, according to some embodiments. In FIG. 1, a wagering game system ("system") 100 includes a wagering game machine 160 connected to a wagering game server 150 via a communications network 122. Also connected to the communications network 122 are an account server 170 and a web server 180. The account server 170 can store data for player account 120. The web server 180 can host an online wagering website that provides wagering games via the Internet and other computer networks. The web server 180 can include other devices, servers, mechanisms, etc., that provide functionality (e.g., controls, web pages, applications, etc.) that web users can use to connect to the online wagering website and utilize website features (e.g., communications mechanisms, applications, etc.). The wagering game server 150 can provide wagering games to the wagering game machine 160 within a casino network. The wagering game machine 160 can present wagering game content ("primary content") 102 (e.g., cards 107, bet control 117, bet meter 115, credit meter 113, game activation control 109, card meter 111, etc.). The wagering game machine 160 can present the wagering game content in a first display (e.g., a primary display screen). The wagering game machine 160 can present additional wagering game content ("secondary content") 101. The secondary content 101 can include an award ladder game 130. In some embodiments, the award ladder game 130 can provide awards, or prizes, to players, from an award ladder 105, based on achievement of predetermined criteria listed in an achievement list 103. The award ladder 105 has awards (e.g., award list 112) that have a sequential order of value on the award ladder 105 according to the award's value (e.g., awards on the award ladder 105 are listed in an ascending order of lowest value to highest value). The award ladder game 130 can provide the awards on the award ladder 105 in a "stair-step" fashion to the player account 120 if the player account 120 achieves, or obtains, the specific pre-determined criteria ("achievements") listed in the achievement list 103. The achievements in the achievement list 103 correlate to potential activity, events, triggers, etc., that can occur, appear, result, etc. from the activity of the primary content 102. For example, the achievement list 103 includes a listing (e.g., eligible-achievement list 106) of card combinations that may appear on the cards 107 from a video poker game 140 in the primary content 102. The award ladder game 130 watches a player account's playing activity with the primary content 102. The award ladder game 130 can determine when an event, or trigger, occurs during the video poker game 140 that correlates with one of the specific achievements listed in the achievement list 103 (e.g., in the eligible-achievement list 106). For instance, if the cards 107 show a card arrangement that is all spades (i.e., a flush of spades), the award ladder game 130 can reference its achievement list 103 and determine whether the achievement list 103 list an eligible arrangement (e.g., combination, configuration, etc.) of five spades. In the example shown in FIG. 1, the achievement list 103 includes an eligible combination of five spades. The award ladder game 130 can then provide an award, or prize, from the award ladder 105 in a "stair-step" fashion, where it awards the next-sequential award on the award ladder (e.g., on the award list 112) regardless of the nature of the pre-specified achievement. For instance, even though the five-spades card combination had relatively low odds of occurring compared to other eligible card combinations, the award ladder 105 still provides the next sequential award (e.g., the $60 award). In other words, the award ladder game 130 can award a next-sequential award on the award ladder 105 if an event occurs that matches one of the group of pre-specified achievements, regardless of the event's odds of occurrence, payout amount, difficulty, etc.

Although FIG. 1 describes some embodiments, the following sections describe many other features and embodiments. Further, as mentioned above, an award ladder game may be associated with secondary content that is associated with (e.g., monitors, interacts with, etc.) primary content. Consequently, herein, an award ladder game may also be referred to as a "secondary" game. "Secondary" in some embodiments can refer to an application's importance or priority of the data. In some embodiments, "secondary" can refer to a distinction, or separation, from a "primary" application (e.g., separate application files, separate content, separate states, separate functions, separate processes, separate programming sources, separate processor threads, separate data, separate control, separate domains, etc.). For example, a primary game can be a wagering game ("primary wagering game") played by a player account. The player account places wagers on the primary wagering game. The primary wagering game has pay tables that list payable outcome configurations (e.g., certain winning combinations, arrangements, or configurations of playing elements) that payout on bets if the random outcome configuration of the primary wagering game matches one of the payable outcome configurations listed in the pay table. The primary wagering game can also have non-payable activity, events, outcome configurations (e.g., non-winning combination of playing elements), etc. The award ladder game can be a secondary game that watches the activity of the primary wagering game for the occurrence of a pre-determined set of payable or non-payable activity, events, etc. in the primary wagering game. Further, even though primary games and secondary games may be referred to as being separate applications, in some embodiments, secondary content and control can be passed between applications (e.g., via application programming interfaces), thus becoming, or falling under the control of, primary content or primary applications, and vice versa. Further, in some embodiments, secondary games can be developed into primary games as an integrated, single application.

Example Operating Environments

This section describes example operating environments and networks and presents structural aspects of some embodiments. More specifically, this section includes discussion about wagering game system architectures.

Wagering Game System Architecture

Figure 2:
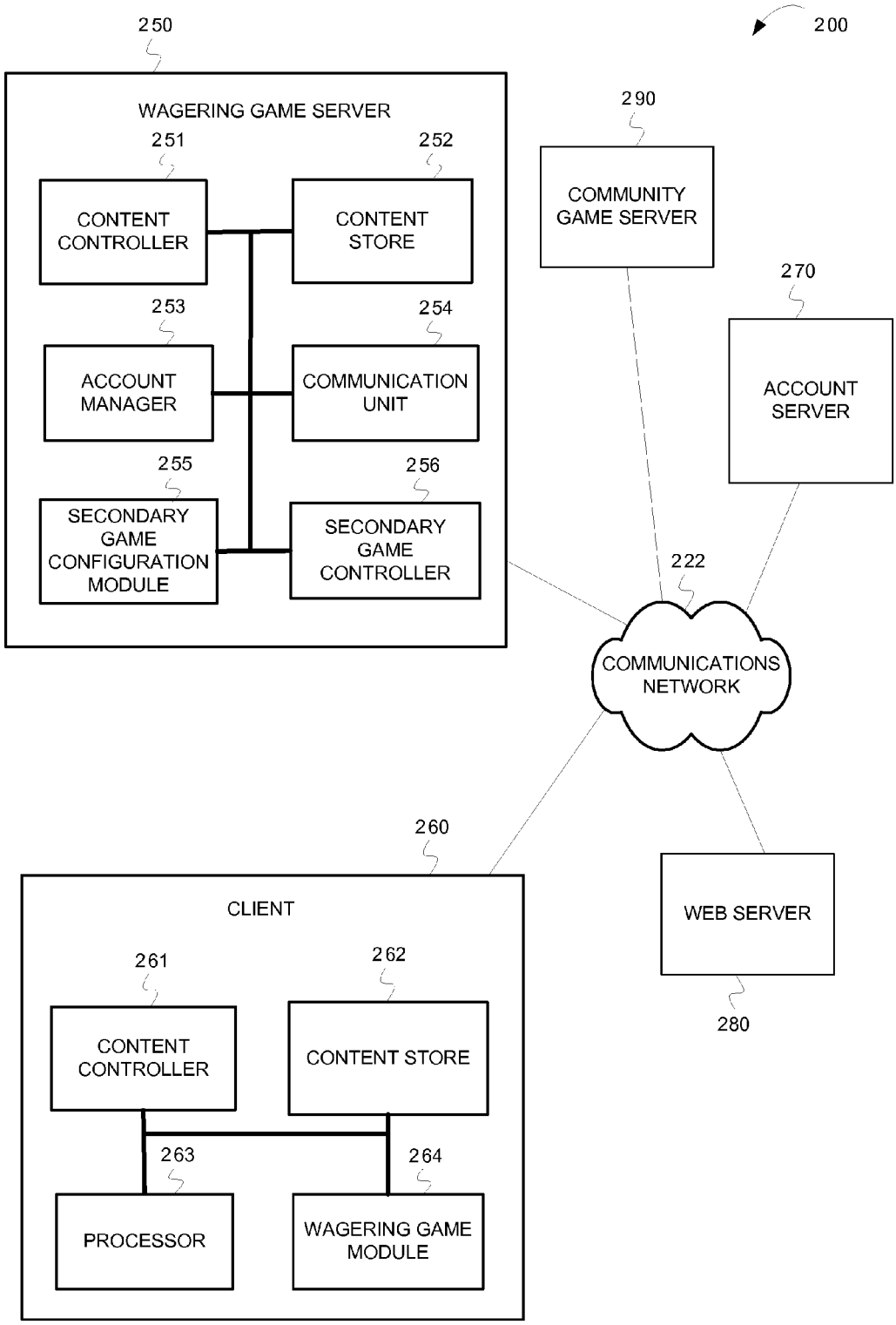
FIG. 2 is an illustration of a wagering game system architecture 200, according to some embodiments.

FIG. 2 is a conceptual diagram that illustrates an example of a wagering game system architecture 200, according to some embodiments. The wagering game system architecture 200 can include an account server 270 configured to control user related accounts accessible via wagering game networks and social networks. The account server 270 can store wagering game player account information, such as account settings (e.g., settings related to group games, settings related to social contacts, etc.), preferences (e.g., player preferences regarding award types, preferences related to virtual assets, etc.), player profile data (e.g., name, avatar, etc.), and other information for a player's account (e.g., financial information, virtual assets, etc.). The account server 270 can store and track player information, such as identifying information (e.g., avatars, screen name, account identification numbers, etc.) or other information like financial account information, social contact information, etc. The account server 270 can contain accounts for social contacts referenced by the player account. The account server 270 can also provide auditing capabilities, according to regulatory rules, and track the performance of players, machines, and servers.

The wagering game system architecture 200 can also include a wagering game server 250 configured to control wagering game content, provide random numbers, and communicate wagering game information, account information, and other information to and from a client 260. The wagering game server 250 can include a content controller 251 configured to manage and control content for the presentation of content on the client 260. For example, the content controller 251 can generate game results (e.g., win/loss values), including win amounts, for games played on the client 260. The content controller 251 can communicate the game results to the client 260. The content controller 251 can also generate random numbers and provide them to the client 260 so that the client 260 can generate game results. The wagering game server 250 can also include a content store 252 configured to contain content to present on the client 260. The wagering game server 250 can also include an account manager 253 configured to control information related to player accounts. For example, the account manager 253 can communicate wager amounts, game results amounts (e.g., win amounts), bonus game amounts, etc., to the account server 270. The wagering game server 250 can also include a communication unit 254 configured to communicate information to the client 260 and to communicate with other systems, devices and networks. The wagering game server 250 can also include a secondary game configuration module 255 configured to configure secondary games to utilize subsets of possible wagering game activity, or events, (e.g., potential slot reel combinations, potential card hands, potential roulette outcomes, consecutive game outcomes for a player account, etc.) as achievements for a secondary game. The secondary game configuration module can also generate award ladders and correlate award ladders to the wagering game activity. The wagering game server 250 can also include a secondary game controller 256 configured to provide content and control information for secondary games and other secondary content available on a wagering game network (e.g., secondary game content, promotions content, advertising content, player tracking content, web content, etc.). The secondary game controller 256 can track player account registrations for secondary games, determine player account activity in primary wagering games (and in some cases activity in other secondary games), and pay out awards according to an award ladder for an award ladder game based on the player account activity.

The wagering game system architecture 200 can also include the client 260 configured to present wagering games and receive and transmit information to award achievements in wagering games. The client 260 can be a computer system, a personal digital assistant (PDA), a cell phone, a laptop, a wagering game machine, or any other device or machine that is capable of processing information, instructions, or other data provided via a communications network 222. The client 260 can include a content controller 261 configured to manage and control content and presentation of content on the client 260. The client 260 can also include a content store 262 configured to contain content to present on the client 260. The client 260 can also include a processor 263 configured to process wagering game content, present online wagering game objects, control gaming devices, etc. The client 260 can also include a wagering game module 264 configured to control activities for primary and secondary applications, determine occurrence of activity or events during gaming applications, and provide awards for matching achievements associated with award ladders (e.g., provide awards in a stair-step ladder process, provide next-sequential awards, etc). The wagering game module 264 can also be configured to control data associated with group games, such as group game activity, group game statistics, tracking virtual assets for group games, etc.

The wagering game system architecture 200 can also include a web server 280 configured to control and present an online website that hosts wagering games. The web server 180 can also be configured to present primary and secondary applications, including award ladder games. The web server 180 can also be configured to present and control group game progress reports, player account information, award redemption features, virtual economy information, etc.

The wagering game system architecture 200 can also include a community game server 290 configured to provide and control content for community games, including networked games, social games, competitive games, or any other game that multiple players can participate in at the same time. Some community games can include group scavenger hunt games.

Each component shown in the wagering game system architecture 200 is shown as a separate and distinct element connected via the communications network 222. However, some functions performed by one component could be performed by other components. For example, the wagering game server 250 can also be configured to perform functions of the community game server 290, the web server 280, the account server 270, the wagering game module 264, and other network elements and/or system devices. Furthermore, the components shown may all be contained in one device, but some, or all, may be included in, or performed by multiple devices, as in the configurations shown in FIG. 2 or other configurations not shown. For example, the account manager 253 and the communication unit 254 can be included in the client 260 instead of, or in addition to, being a part of the wagering game server 250. Further, in some embodiments, the client 260 can determine wagering game outcomes, generate random numbers, etc. instead of, or in addition to, the wagering game server 250.

As mentioned previously, in some embodiments, the client 260 can take the form of a wagering game machine. Examples of wagering game machines can include floor standing models, handheld mobile units, bar-top models, workstation-type console models, surface computing machines, etc. Further, wagering game machines can be primarily dedicated for use in conducting wagering games, or can include non-dedicated devices such as mobile phones, personal digital assistants, personal computers, etc.

In some embodiments, clients and wagering game servers work together such that clients can be operated as a thin, thick, or intermediate clients. For example, one or more elements of game play may be controlled by the client or the wagering game servers (server). Game play elements can include executable game code, lookup tables, configuration files, game outcome, audio or visual representations of the game, game assets or the like. In a thin-client example, the server can perform functions such as determining game outcome or managing assets, while the client can present a graphical representation of such outcome or asset modification to a user (e.g., player). In a thick-client example, the clients can determine game outcomes and communicate the outcomes to the server for recording or managing a player's account.

In some embodiments, either the client or the wagering game server(s) can provide functionality that is not directly related to game play. For example, account transactions and account rules may be managed centrally (e.g., by the wagering game server(s)) or locally (e.g., by the client). Other functionality not directly related to game play may include power management, presentation of advertising, software or firmware updates, system quality or security checks, etc.

Furthermore, the wagering game system architecture 200 can be implemented as software, hardware, any combination thereof, or other forms of embodiments not listed. For example, any of the network components (e.g., the wagering game machines, servers, etc.) can include hardware and machine-readable storage media including instructions for performing the operations described herein. Machine-readable storage media includes any suitable component that stores and provides information in a form readable by a machine (e.g., a wagering game machine, computer, etc.). For example, machine-readable storage media includes any suitable memory device, such as semi-conductor read only memory and semi-conductor random access memory. Machine-readable storage media can also include magnetic disk storage media, optical storage media, flash memory machines, organic memory devices, etc.

Example Operations

This section describes operations associated with some embodiments. In the discussion below, some flow diagrams are described with reference to block diagrams presented herein. However, in some embodiments, the operations can be performed by logic not described in the block diagrams.

In certain embodiments, the operations can be performed by executing instructions residing on machine-readable storage media (e.g., software), while in other embodiments, the operations can be performed by hardware and/or other logic (e.g., firmware). In some embodiments, the operations can be performed in series, while in other embodiments, one or more of the operations can be performed in parallel. Moreover, some embodiments can perform more or less than all the operations shown in any flow diagram.

Figure 3:
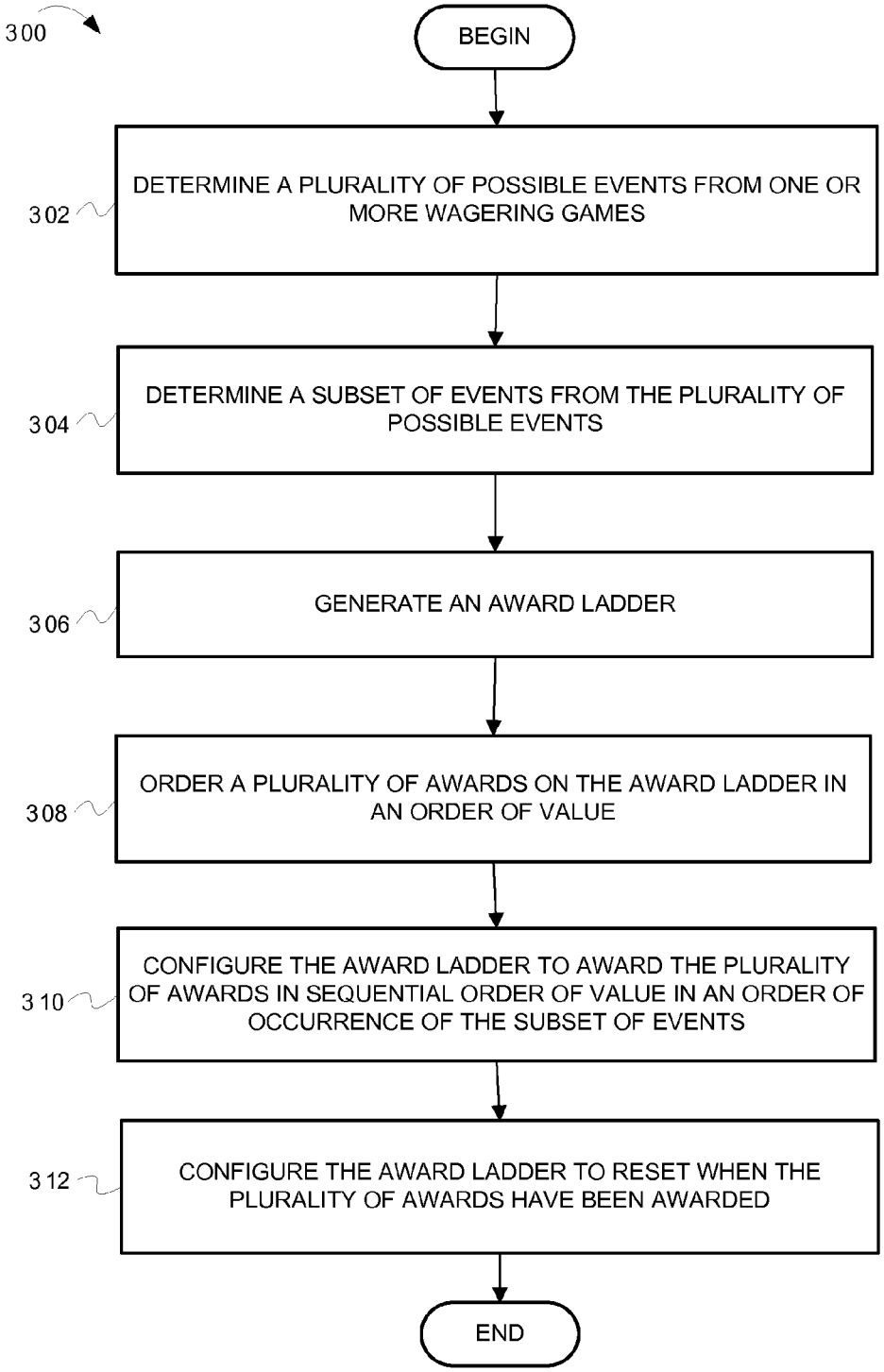
FIG. 3 is a flow diagram 300 illustrating generating and configuring wagering game award ladders, according to some embodiments.
Figure 5:
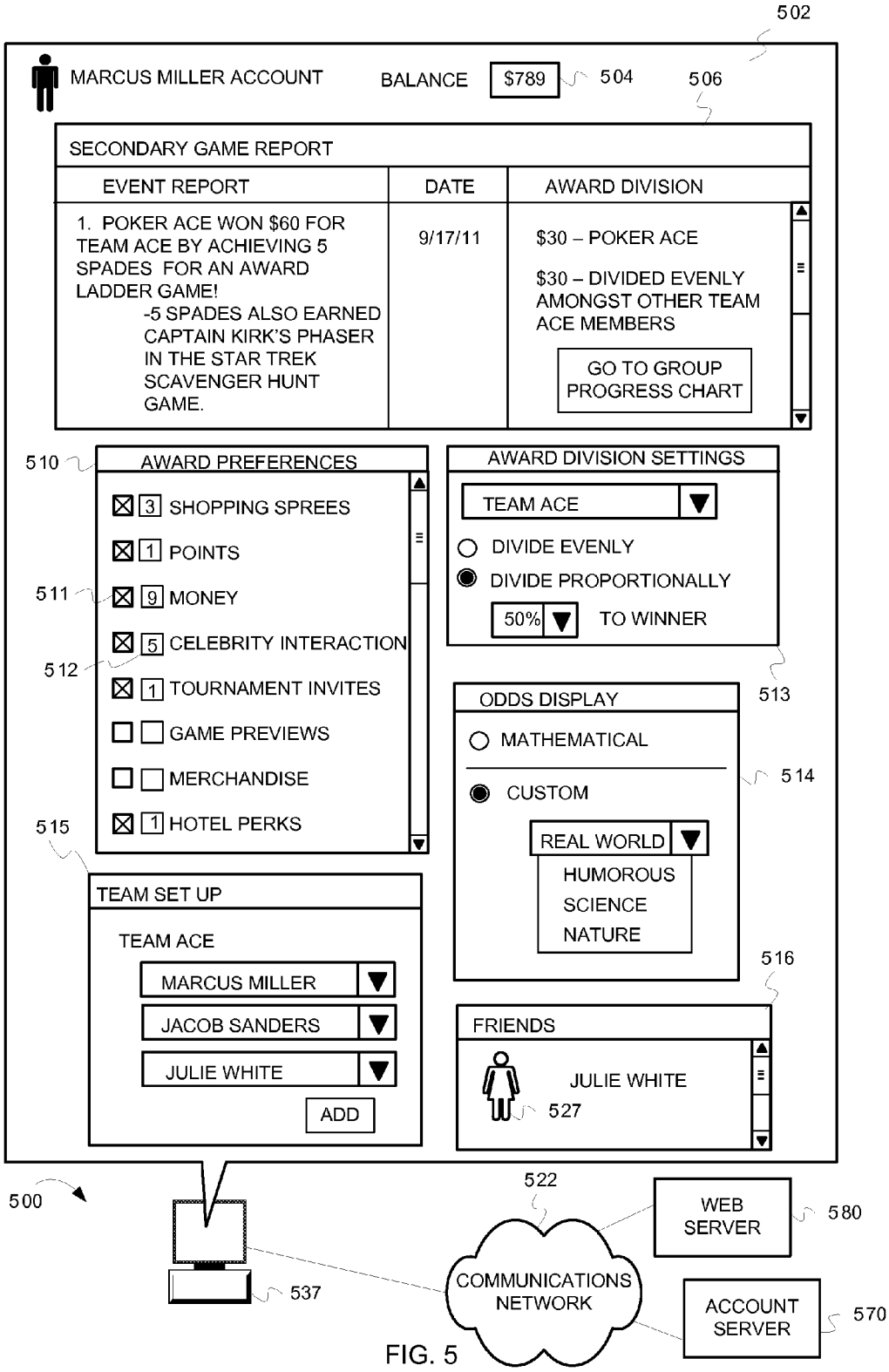
FIG. 5 is an illustration of configuring secondary game award settings, according to some embodiments.

FIG. 3 is a flow diagram ("flow") 300 illustrating generating and configuring wagering game award ladders, according to some embodiments. FIGS. 1 and 5 are conceptual diagrams that help illustrate the flow of FIG. 3, according to some embodiments. This description will present FIG. 3 in concert with FIGS. 1 and 5. In FIG. 3, the flow 300 begins at processing block 302, where a wagering game system ("system") determines a plurality of possible events from one or more wagering games. The plurality of possible events ("events") can be ascertainable and achievable wagering game events. The events can be ascertainable and achievable because they will occur, at some point, during a wagering game over a period of plays, or with activity associated with the wagering game. The events can be programmed result listings associated with wagering games, payout tables that indicate payable game results, combinations or arrangements of wagering game playing elements, appearance of specific items in a wagering game, sequences of events that occur in a wagering game (e.g., consecutive game hands), mystery events (e.g., independent events from game activity or functionality), etc. The possible events can all be different from each other, though they do not necessarily have to be. In some embodiments, the system can determine events from configurations, data, files, records, etc. of the one or more wagering games. In some embodiments, the system can determine one or more payable events from pay tables of one or more primary wagering games (e.g., configurations of slot game reel elements that payout for a wagering game according to the slot game payout table, configurations of poker cards that win, etc.). In some embodiments, the system can also determine non-payable events from the one or more primary wagering games, such as non-winning combinations of slot reel elements, bonus game activity, player registration activity, marketing participation, etc. In some embodiments, the system can also determine secondary game events associated with secondary content, instead of, or in addition to, primary wagering game events. For example, an award ladder secondary game can monitor primary wagering games for events that are not awarded by primary wagering games, but that are used in other secondary games to indicate progress in the other secondary games. A group scavenger hunt game is an example of another secondary game that an award ladder secondary game can monitor for events. A group scavenger hunt game is a game where a group of player accounts can compete, individually or in groups, to obtain achievements in wagering games. The group of player accounts can receive virtual assets as awards for obtaining the achievements. The achievements can be based on events that occur in wagering games. For instance, an event for a group scavenger hunt game may be consecutive three-of-a-kind hands that occur during a video poker game. The video poker game may not award consecutive three-of-a-kind hands merely because they are consecutive. In other words, payout tables for the poker game may not award the three-of-a-kind hands unless they were the highest hands for a poker round. However, the group scavenger hunt game can consider the consecutive three-of-a-kind hands as an awardable event for the group scavenger hunt game. The group scavenger hunt game can monitor the video poker game and use the consecutive three-of-a-kind hands. The award ladder secondary game can use the same event for the group scavenger hunt game (e.g., the consecutive three-of-a-kind hands) as an awardable event for the award ladder secondary game. The system can search through configuration files, game libraries, code, etc. that store the awardable events for the primary wagering games and/or other secondary games (e.g., group scavenger hunt games) to determine possible events to use for an award ladder.

The flow 300 continues at processing block 304, where the system determines a subset of events from the plurality of possible events. The system can generate a game event list from the subset of game events. The game event list includes a listing of the events from the subset ("subset-events"), which the award ladder game can use as awardable, or eligible, achievements for the award ladder game. The subset-event listing may be referred to as an "eligible-achievements" list or a "subset-events" list. For example, in FIG. 1, the award ladder game 130 includes the eligible-achievement list 106. The eligible-achievement list 106 includes the possible events (e.g., the eligible poker-hand combinations) for the video poker game 140. Returning to FIG. 3, the system can also determine corresponding odds for the subset of game events on the eligible-achievements list and create an odds list. The odds list can present corresponding odds so that players can know the odds of possibly achieving one of the awardable events on the eligible-achievements list. For example, in FIG. 1, the achievement list 103 can include a frequency list 108 which displays odds, or frequency of occurrences, of the events listed in the eligible-achievement list 106. Returning to FIG. 3, in some embodiments, the system can create an achieved-event list for the subset game events to track whether the events on the eligible-achievement list have been achieved for the award ladder game. For example, in FIG. 1, the achievement list 103 includes an availability list 110 which indicates both events that have already been achieved (e.g., via an "x" indicator) and events that have not been achieved (e.g., indicated by a "YES" indicator) or that are still available for achievement. The availability list 110 is only one example of an achieved-event list. For instance, in some embodiments, an achieved-event list can utilize different types of indicators. In other embodiments, the achieved-event list can be integrated with the eligible-achievement list 106, such as by crossing out or removing non-eligible items, or events, listed in the eligible-achievement list 106 after the events have been achieved.

The flow 300 continues at processing block 306, where the system generates an award ladder. The award ladder can include a listing of a plurality of awards. The number of awards can correlate with the number of subset game events in the achievement list. The award number can correlate exactly, proportionality, or some other way (e.g., one to one correlation, one to two—meaning that and an event can occur twice and an award is provided each of the two times that event occurs, etc.). In some embodiments, the system can provide monetary or non-monetary awards. In some embodiments, the system can determine player preferences regarding types of awards to be included on an embodiment of an award ladder that adjusts award listings based on player preferences. For instance, in FIG. 5 a player account 502 can specify award preferences 510 that indicate types of awards, or award classifications. In FIG. 5, a wagering game system ("system") 500 includes a computer 537 connected to an account server 570 via a communications network 522. A web server 580 can also be connected to the communications network 522. The account server 570 can store the player account 502. A player can access the player account 502 via the computer 537. In some embodiments, the web server 580 can host a website that provides access through which a player can log on to the player account 502 using the computer 537. In other embodiments, a player can access the player account 502 via a wagering game machine or other device (e.g., a cell phone, a personal digital assistant, etc.) that can access the communications network 522. For instance, referring momentarily to FIG. 1, a player can access the player account 502 by activating a secondary game report control 119. Upon activating the secondary game report control 119, the wagering game machine 160 can present the player account 502. Returning to FIG. 5, the player account 502 can include various settings that relate to wagering games, award ladder games, and other secondary games. For example, the player account 502 can include an account balance indicator 504 that indicates a financial balance that the player account 502 utilizes during wagering games from which to make bets and to store gambling winnings. The player account 502 can also include the award preferences 510. The award preferences 510 can include selection controls 511 for selecting types of awards that a player account would prefer and which the system 500 can use to provide an award ladder. The player account 502 can also include a secondary game report console 506 to indicate awards won via award ladder games and other secondary games. For example, the secondary game report console 506 indicates a report of an award in FIG. 1. For instance, referring momentarily to FIG. 1, the five-spade flush was an event that won a next-sequential award on the award ladder 105. However, returning to FIG. 5, the secondary game report console 506 reports that the five-spade flush event was also an event for a scavenger hunt game (e.g., the Star Trek Scavenger Hunt Game). The secondary game report console 506 also indicates other information for the award, such as the date that the award was made and a division of the award. In some embodiments, the system 500 can divide awards received from award ladder games. The player account 502 can include award division settings 513 where teams, or groups, agree to split awards. The award division settings 513 can specify an agreement of multiple players to divide possession rights for awards earned by player accounts in some wagering games or secondary type games. The player account 502 can include team settings 515 used to indicate teams or groups. The player account 502 can also include settings 513 related to different ways of presenting odds on an achievement list as mathematical odds versus customized textual description of odds (e.g., "odds of getting struck by lightning," "odds of getting in a car accident in Los Angeles after midnight," "odds of being selected for jury duty," etc.). The player account 502 can also include social contact settings 516 which a player can use to specify account information, contact information, personal information, avatars, etc. for friends or acquaintances associated with the player account 502.

The flow 300 continues at processing block 308, where the system orders a plurality of awards on the award ladder in an order of value. In some embodiments, the system can order the awards in a sequential order (e.g., ascending or descending) of values. For example, the system can order the award values starting with the lowest valued award one end of the award list (e.g., the bottom of the award list) and the award values can follow an escalating order of values to the highest award value. In some embodiments, where the awards are non-monetary, the system can order the awards in a perceived order of value (e.g., closest approximate market value for the award, a virtual economy value, etc.). In some embodiments, where the system has no reference for a value, the system can provide options for players to select an award (e.g., directly select, select from a grab-bag, etc.) or can randomly assign awards. In some embodiments, the system can order the awards according to preferences for the player, such as by settings for the player account that indicate how much personal value a non-monetary award has to the player account. For example in FIG. 5, the award preferences can include ranking controls 512 that a player can use to rate or rank award preferences. The system 500 can use the rankings to determine how much a player values a non-monetary type of award based on numerical values specified in the rankings.

The flow 300 continues at processing block 310, where the system configures the award ladder to award the plurality of awards in sequential order of value in an order of occurrence of the subset of events. In some embodiments, the system can configure an award list to indicate a next-sequential award that is still eligible to be awarded, such as an award that has not been awarded yet, but is the next-sequential award on the award list. For example, in FIG. 1, the award ladder 105 can include the award list 112 showing that the $60 award is next in sequence of awards that have not been awarded yet. The award ladder 105 can includes an award achievement indicator 114 that specifies which awards have already been awarded and which awards are yet to be awarded. The presentation of the award list 112 and the award achievement indicator 114 indicate to a player what the next award will be. The award ladder 105 can also include a next-award indicator 116 to specifically point out that the $60 award is next is sequence of unawarded awards and will be awarded when the next available event is achieved from the achievement list 103. The award ladder game 130 can award the next-sequential award regardless of any criteria other than being first in time to achieve the event (e.g., regardless of the achieved game event properties, player account properties, betting amounts, difficulty of an event, payout amount associated with an event, associated bet amounts by a player account, player status, duration of play, etc.). For example, occurrence rates of some game events can be different as indicated by the frequency list 108. Some events can have very low odds of occurrence, some very high, some in between (e.g., a range of frequency of occurrences). However, the award ladder game 130 can still award the next-sequential award on the awards list 112 regardless of the odds or frequency of occurrence for any of the remaining eligible events. However, in some embodiments, the system 100 can provide additional awards (e.g., award multipliers, entertainment points, perks, etc.) based on the event properties, player account properties, or other factors. In some wagering games, when an outcome has a lower probability of being achieved, an award is generally higher. However, with an award ladder, the award amount on the award ladder can be completely independent from the likelihood and probability of the outcome. Returning now to FIG. 3, in some embodiments, the system can configure an award ladder to award prizes only for a first time that a subset game event occurs (e.g., until the award ladder is reset) so that every time a player account is the first to attain an achievement the player account receives the next highest award available on the award ladder. In other embodiments, however, the system can provide award ladder prizes multiple times. For instance, in FIG. 1, the award ladder 105 can award the $60 prize, and all other prizes twice, instead of once. The achievement list 103 can also maintain the achievements as eligible until they are attained twice. In some embodiments, the number of awards in the award ladder 105 can be different from the number of eligible events in the achievement list 103 (e.g., more awards than eligible events or more eligible events than awards). For instance, if there are more awards than eligible events, for example, a two-to-one correlation, the system 100 can maintain each of the eligible events as eligible twice for awards during an award ladder game cycle. An award ladder cycle is the period during which the award ladder game 130 awards all of its awards. When the award ladder game 105 awards all of its awards, then The flow 300 continues at processing block 312, where the system configures the award ladder to reset when the plurality of awards have been awarded. In some embodiments, a game controller can control the award ladder, can track the progress of the awards, and can determine when all of the plurality of awards has been awarded. The system can then reset the award ladder and begin awarding the awards in order of value (e.g., from the lowest award value in ascending order). In some embodiments, the system can increase or decrease the awards by a degree. In some embodiments, the system can determine the degree of award values to use based on a progressive bonus account. The progressive bonus account can store an amount of money that has been held from previous games played by the player account or other player accounts, and contributed to the progressive account to be used for bonus games rewards, jackpots, or other secondary type games. The system can determine wagering game machines that have been configured to present wagering games that use progressive accounts and configure award ladders on those wagering game machines to take into consideration the progressive account. For example, a wagering game that features a secondary progressive game may require higher bets, but may also entice players to play by offering higher award ladders than other games that do not utilize progressive accounts. In some embodiments, the system can also utilize marketing funds or sponsorship funds to provide awards. For example, the system can set the degree of awards based on prizes or money offered by a sponsor, such as from a casino or a marketing partner (e.g., from a casino that offers money from a marketing account, from an online casino that offers entertainment points, from a retailer that offers a shopping spree, from an e-tailer that offers a discount on merchandise, from an online affiliate partner that offers a free subscription to a website, etc.).

Figure 4:
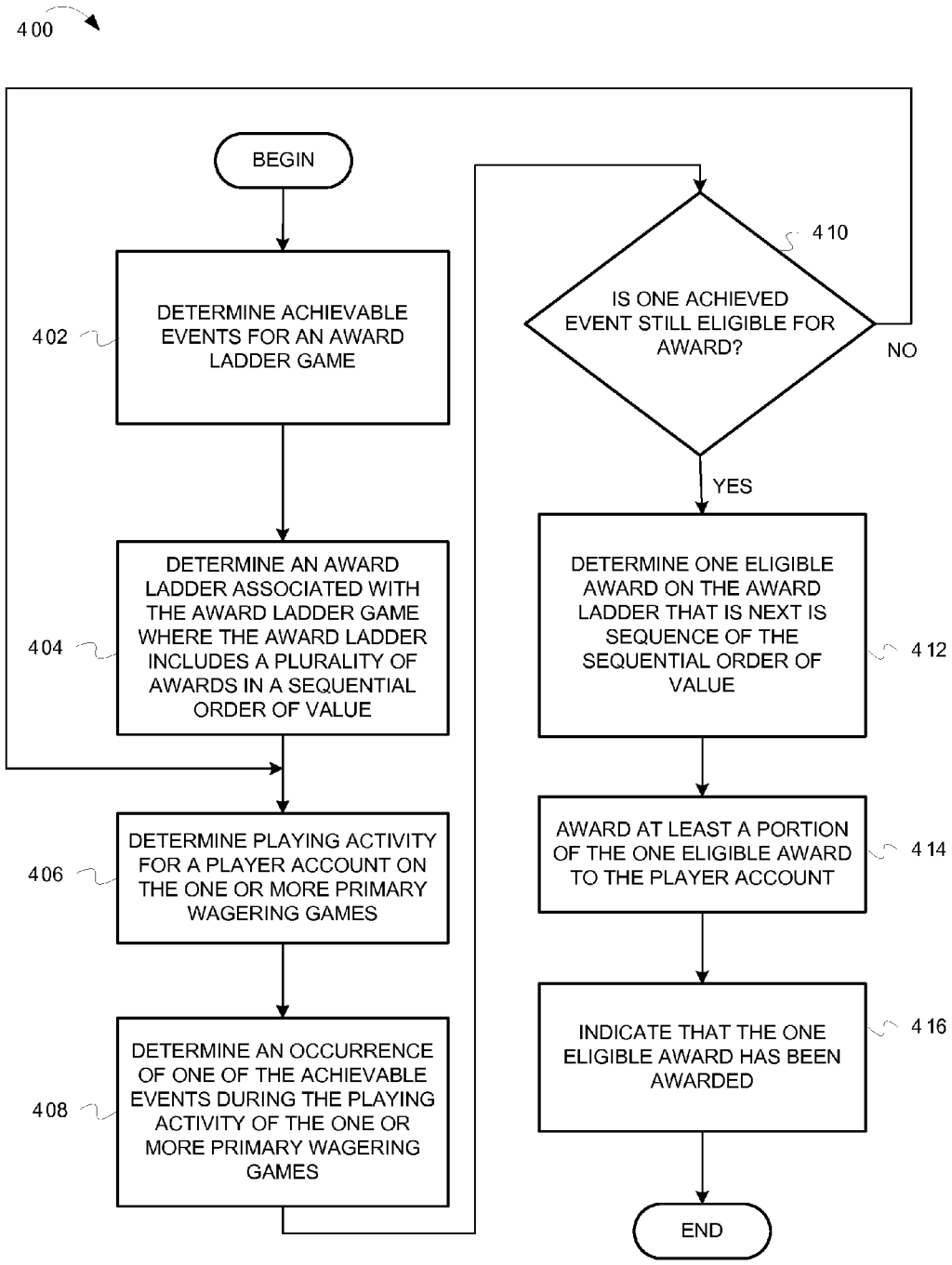
FIG. 4 is a flow diagram 400 illustrating controlling secondary game awards for primary wagering game achievements, according to some embodiments.
Figure 6:
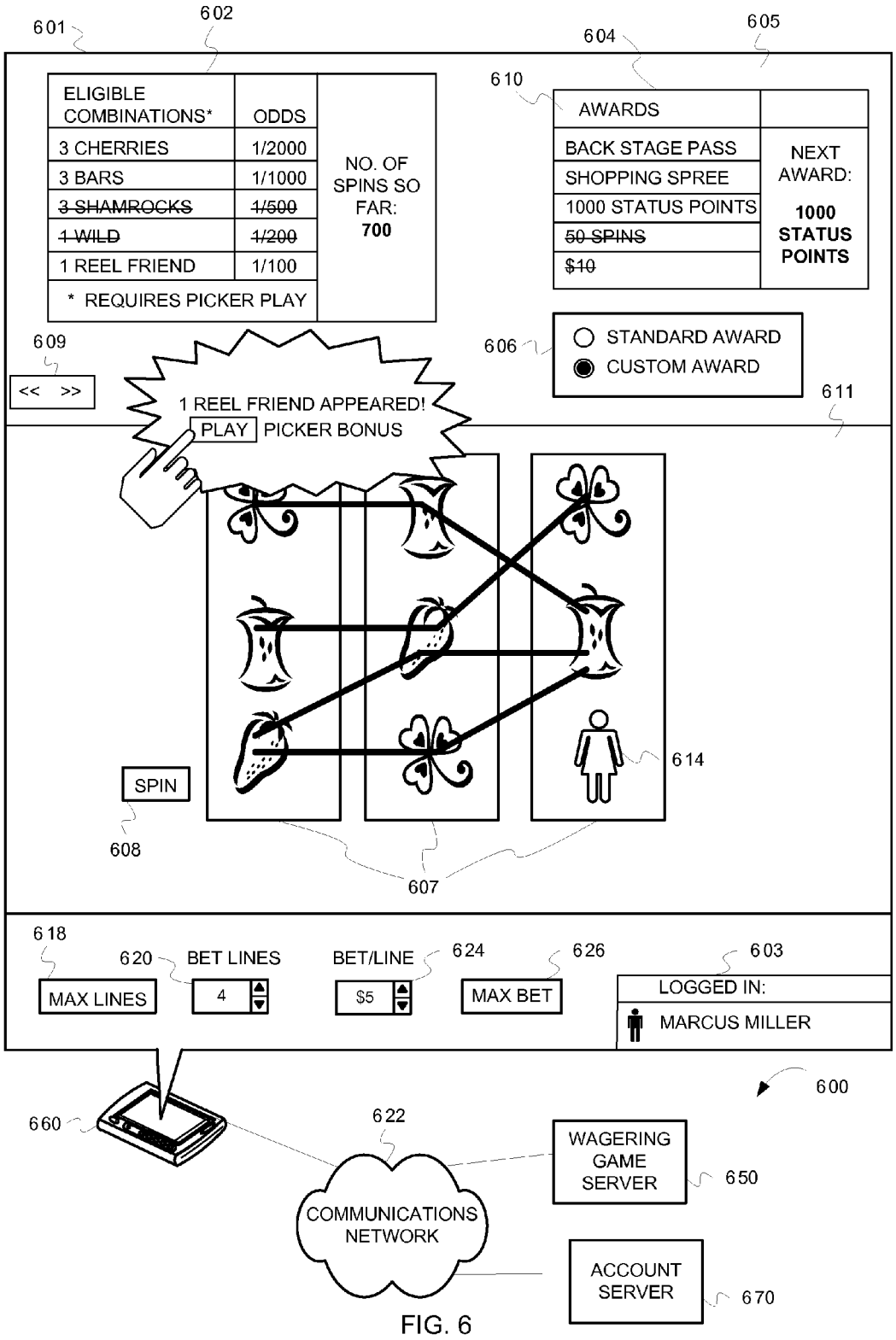
FIG. 6 is an illustration of controlling secondary game awards, according to some embodiments.
Figure 7:
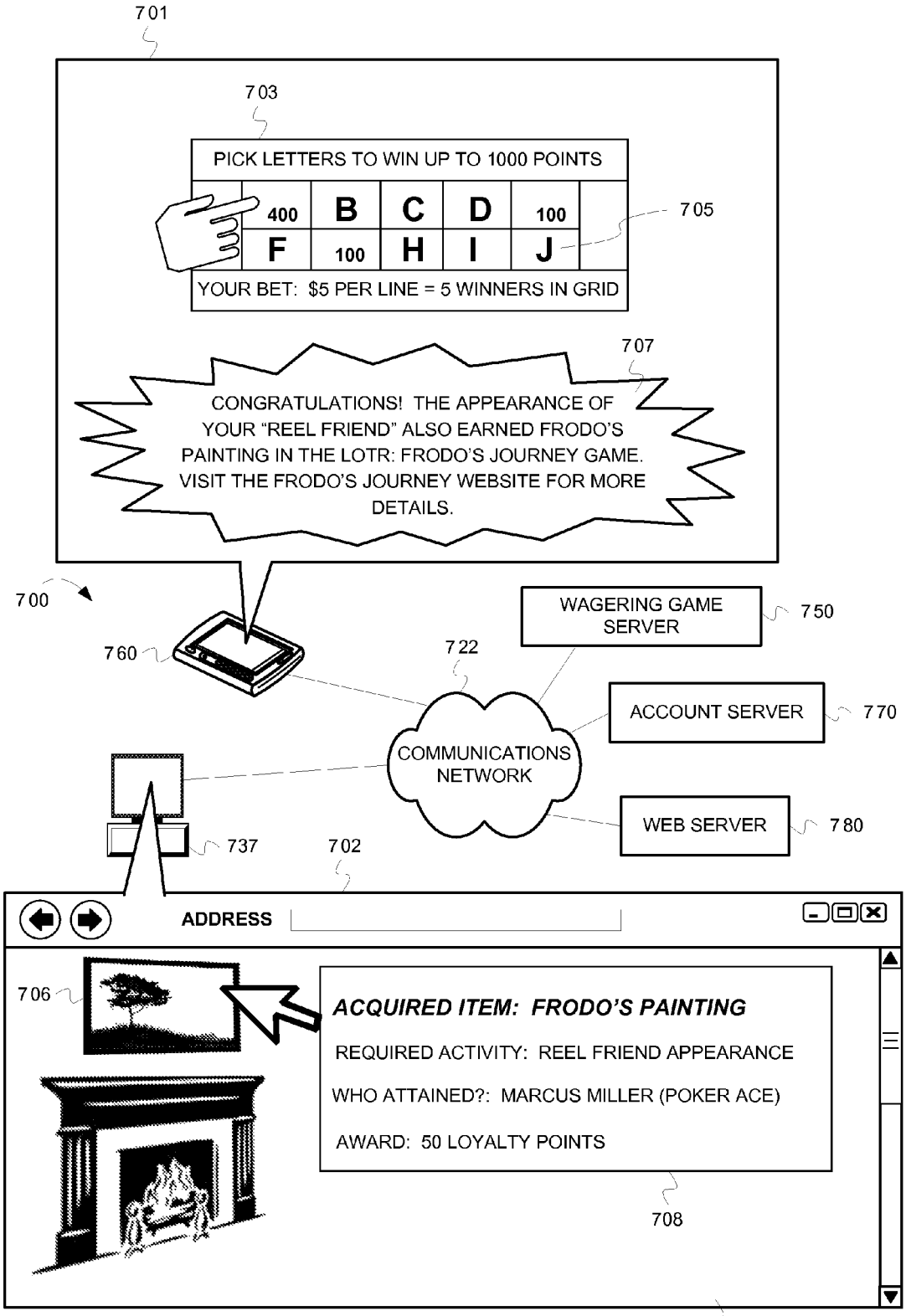
FIG. 7 is an illustration of presenting secondary game award mechanisms associated with primary wagering game settings, according to some embodiments.

FIG. 4 is a flow diagram ("flow") 400 illustrating controlling secondary game awards for primary wagering game achievements, according to some embodiments. FIGS. 6, and 7 are conceptual diagrams that help illustrate the flow of FIG. 4, according to some embodiments. This description will present FIG. 4 in concert with FIGS. 6 and 7. In FIG. 4, the flow 400 begins at processing block 402, where a wagering game system ("system") determines a plurality of possible events that can be achieved for an award ladder game. The system can list the plurality of possible events in an achievement list for the award ladder game. As described previously, the award ladder game can be a secondary game that monitors a subset of a plurality of possible primary wagering game events from one or more primary wagering games. The subset of the plurality of possible wagering game events may be referred to as "subset game events." The system can present the subset game events in a secondary game event list, or achievement list, as described above. The system can present the achievement list on a wagering game machine, in a web page, or any other location accessible to wagering game players. For example, as seen previously in FIG. 1, the system 100 presents the achievement list 103 on the wagering game machine 160. The achievement list 103 is part of the award ladder game 130, and is presented on a display (e.g., on a top-box display) of the wagering game machine 160 to advertise the existence of an underlying secondary game that is associated with a primary wagering game. In some embodiments, the achievement list can include sub-lists and other information (e.g., eligible-achievement lists, odds lists, achieved-event list, etc.). FIG. 6 includes an example of an achievement list 602 for an award ladder game 605. In FIG. 6, a wagering game system ("system") 600 includes a mobile wagering game machine ("mobile machine") 660 connected to a wagering game server 650 and an account server 670 via a communications network 622. The mobile machine 660 presents a display 601. The mobile machine 660 can present the achievement list 602 for the award ladder game 605. The award ladder game 605 can be a secondary game that is associated with primary wagering game content, such as a slot game 611. The slot game 611 can include reels 607, a spin control 608, and betting controls, such as a bet meter 624, a maximum bet control 626, a pay line control meter 620 and a maximum pay line control 618. A player account 603 can be logged in to the mobile machine 660. The achievement list 602 includes possible events, in this case reel configuration combinations, which are monitored by the award ladder game 605. If events occur (i.e., are achieved) during a wagering game session which match the events listed in the achievement list 602, the award ladder game 605 can indicate that they are achieved, such as by crossing them off the achievement list 602. The achievement list 602 can also include other information such as a play counter that indicates a number of plays that have cycled in the award ladder game 605 over time. The system 600 can also present, on the achievement list 602, odds of occurrence of eligible reel configuration combinations. The reel configurations line up on the reels 607. The system 600 can modify the odds list based on variations of play. For example, in a group game of Texas Hold-Em', the odds can change based on a number of players playing a game. For some slots game, the odds would generally remain unchanged because the number of players is set at one. However, for group games, the system 600 can change the odds of eligible event achievements based on the game variables. In some embodiments, the system 600 can present options to select from one or more different award ladder games (e.g., a control 609 on the mobile machine, where a player can browse through different award ladder games that has listed achievements/events that are compatible with the slot game 611). In some embodiments, however, the award ladder game can be tied to (e.g., persist with) the mobile machine 660 and may not be selectable. In some embodiments, the system 600 can present the award ladder game 605 as a group award ladder game that is shared amongst specific players in a group so that when one of the player accounts logs in to a wagering game session, for a specific game type, the group award ladder game appears. In some embodiments, the group members can register for the specific award ladder game ahead of time to compete for the awards in that game.

The flow 400 continues at processing block 404, where the system determines an award ladder associated with the award ladder game, where the award ladder includes a plurality of awards in a sequential order of value. As described previously, the award ladder is associated with a secondary game, the award ladder game. Further, the award ladder can include an award list that lists the plurality of awards in the sequential order of value. For example in FIG. 6 the system 600 can present an award ladder 604 associated with the award ladder game 605. The award ladder 604 can include an award list 610. The award list 610 can include awards, as mentioned above, in a sequential order of value. The awards can be monetary and non-monetary. In some embodiments, the system 600 can provide features for a player account to create a custom award ladder by selecting preferred award types and/or providing personal awards that can be used in the award ladder game 605. For example, the system 600 can present an award type selector 606 which the player account 603 can use to select standard awards or customized awards. If the player account 603 selects to play for customized awards, the system 600 can modify the awards listed in the award list 610 to display awards that match player preferences for awards. For instance, the system 600 can read the award preferences 510 (see FIG. 5) and then list and order the awards in the award list 610 based on selected award types and selected preference rankings.

The flow 400 continues at processing block 406, where the system determines playing activity for a player account on the one or more primary wagering games. For example, in FIG. 6, the player account 603 can log in to a wagering game session to play the slot game 611. The system 600 can monitor the activity that occurs during the slot game 611. Specifically, the system 600 determines combinations of slot reel configurations that appear on the reels 607 (e.g., along pay lines or off pay lines, multiple elements or single elements, etc.). The slot game 611 can have hundreds or thousands of different combinations of slot reel configurations, depending on the number of reel elements. However, the system 600 only presents a subset of those combinations for the award ladder game 605 in the achievement list 602.

The flow 400 continues at processing block 408, where the system determines an occurrence of at least one of the achievable events during the playing activity of the one or more primary wagering games. For example, in FIG. 6, the system 600 determines whether any of the slot reel configurations that appear on the reels 607 matches any of the listed events in the achievement list 602. For example, in one embodiment, one of the events (e.g., reel element combinations) listed in the achievement list 602 includes the appearance of a "reel friend" game element 614. The "reel friend" game element 614 may be an identifier of a social contact associated with the player account 603 (e.g., see the social contact settings 516 in FIG. 5 showing an avatar 527 for the social contact "Julie White" which matches the appearance of the "reel friend" game element 614). The system 600 thus determines that one of the events listed in the award list 610 has occurred, or in other words has been "achieved." In some embodiments, the slot game 611 is configured to present reel elements configurations based on random wagering game results. However, even though the appearance of the reel elements may be completely random for the slot game 611, the award ladder game 605 may refer to the select few events in the achievement list as "achievements." In some embodiments, however, the slot game 611 may be configured to have an element of skill that a player can utilize to achieve the events based on the player's skillful manipulation of game controls. Further, in other embodiments, other skill-based wagering games can be presented, instead of, or in addition to, the slot game 611.

The flow 400 continues at processing block 410, where the system determines whether the achieved event is still eligible for an award. For example, the system can have restrictions on the awards ability to provide awards for the same event. The system can prevent awards for an event that has already occurred more than once, or any other specific number of times. For instance, in FIG. 6, the system 600 can determine whether the any subsequent spin for the slot game 611 has produced a "reel friend" element 614 during the current game cycle for the award ladder game 605. If the award ladder game 605 is configured to allow only one appearance of the "reel friend" element 614, and the appearance of the "reel friend" game element 614 is a second or subsequent appearance of a reel friend element, then the system 600 would determine that the appearance of the "reel friend" game element 614 is not eligible for the next-sequential award from the award list 610. Thus, referring momentarily to FIG. 4, the flow 400 would return to the processing block 406 to continue monitoring playing activity. On the other hand, returning to FIG. 6, if the appearance of the "reel friend" game element 614 is the first appearance, then the system 600 determines that the event has not already happened during the award ladder game's current award cycle and thus determines that the appearance of the event is still eligible for an award on the award list 610. Thus, referring again to FIG. 4, the flow 400 would continue at processing block 412.

The flow 400 continues at the processing block 412, where the system determines one eligible award on the award ladder that is next is sequence of the sequential order of value. The one eligible award may be referred to as the "next-sequential award." The one eligible award can be the lowest valued award on the award ladder that is still eligible for award (e.g., that has not been awarded yet, that can be awarded again if the secondary game allows multiple awarding of the same award value, etc.). In some embodiments, the value for the one award is independent of a frequency of occurrence during the primary wagering game activity. Thus, the system can provide the award based on the timing of the triggering event, not on the nature or properties of the event itself.

The flow 400 continues at processing block 414, where the system awards at least a portion of the one eligible award to the player account. For example, in FIG. 6, the system 600 determines an ascending sequential order of value of unawarded awards on the award list 610. The system 600 determines the lowest valued unawarded award on the award list 610 in the ascending sequential order of value. The award ladder game 605 can then award the player account 603 the lowest-valued ladder award that has not already been awarded. In some embodiments, the system 600 can award the entire award to the player account. In some embodiments, the system 600 can determine that the player account 603 is associated with other player accounts that have agreed to share awards. For example, the player account 603 can be part of a team that competes in secondary games. The system 600 can then divide the award amongst the group of player accounts for the team. In some embodiments, the system 600 can require an intermediate activity to receive the award. For example, the award ladder game 605 can require that the player account play a bonus-type of game, such as a picking game, to obtain some or the entire award. The intermediate activity can also be related to game activity and options in the primary wagering game. For example, FIG. 7 illustrates an example of a grid of picking items ("picker-grid") 703 that correlates with betting settings from the slot game 611 in FIG. 6. In FIG. 7, a wagering game system ("system") 700 includes the mobile wagering game machine ("mobile machine") 760 connected to a wagering game server 750 via a communications network 722. The wagering game server 750 can provide both primary and secondary content. The system 700 can also include an account server 770 and a web server 780 also connected via the communications network 722. The mobile machine 760 can present the picker-grid 703 in a display 701. The picker-grid 703 can include a number of picking items 705. The number of picking items 705 can be related to betting settings (e.g., betting amounts, pay line settings, etc.). For example, the number of picking items 705 can equal the maximum possible bet per line for the slot game 611. In another example, the number of winning items in the picker-grid 703 can be equal to a player account's bet per line. Thus, a player who is betting a maximum amount ("max betting") can be guaranteed to win the prize, incentivizing players to max bet. If the player picks a non-winning item, the system 600 can still award the player with some portion of the award. In some embodiments, the display 701 can also present a message 707 indicating that the occurrence of the "reel friend" game element 614, in FIG. 7, triggered a prize in another secondary game, a group scavenger hunt game. A computer 737 connected to the communications network 722 can present a website 704 in a web browser 702. The website 704 can include prize information 708. The prize information 708 can explain an item that was awarded as part of the group scavenger hunt game. The website 704 can also include a depiction of an item 706.

The flow 400 continues at processing block 416, where the system indicates that the one eligible award has been awarded. The system can indicate on the award list that the award was awarded. For example, as shown in FIG. 6, the system can modify the award list to have the "1000 points" prize crossed out. The system 600 can also cross out the "1 Reel Friend" achievement from the achievement list 602. Returning to FIG. 4, the system can continue game play and award ladder awards can escalate until all players attain all of the predetermined achievements and the award ladder game has awarded all of its award. The system can then reset the events in the achievement list and reset the awards for another award ladder game cycle. The system can continue play over multiple gaming sessions and store the award ladder game on a wagering game machine associated with the award ladder game. In some embodiments the system can present the award ladder in online wagering game websites and other gaming venues.

Additional Example Embodiments

According to some embodiments, a wagering game system ("system") can provide various example devices, operations, etc., to award achievements in wagering games. The following non-exhaustive list enumerates some possible embodiments.

In some embodiments, the system can determine events that occur from social contacts' game activity (e.g., primary wagering game events that social contacts play, secondary game events achieved by social contacts, etc.), and use the social contact's game activity to award a player account. For example, in some embodiments, the system can track achievements on a secondary game event list for more than one player account (e.g., a group of accounts), as described further above. In some embodiments, the system can provide additional awards to the player account for being a social contact of a social contact player account that earns an award (e.g., a player account receives a free spin because of its social accounts earned a prize on an award ladder).

In some embodiments, the system can notify friends of awards, share awards, trade awards, etc. For example, in some embodiments, an award ladder can provide non-cash awards, virtual assets, items, etc. A player account, however, may desire to trade or sell a non-cash award. The system, therefore, can provide a virtual economy, or trading mechanism, for players to trade virtual assets (e.g., trade playing rights, trade trophies, sell player appreciation points, etc.).

Additional Example Operating Environments

This section describes example operating environments, systems and networks, and presents structural aspects of some embodiments.

Computer System

Figure 8:
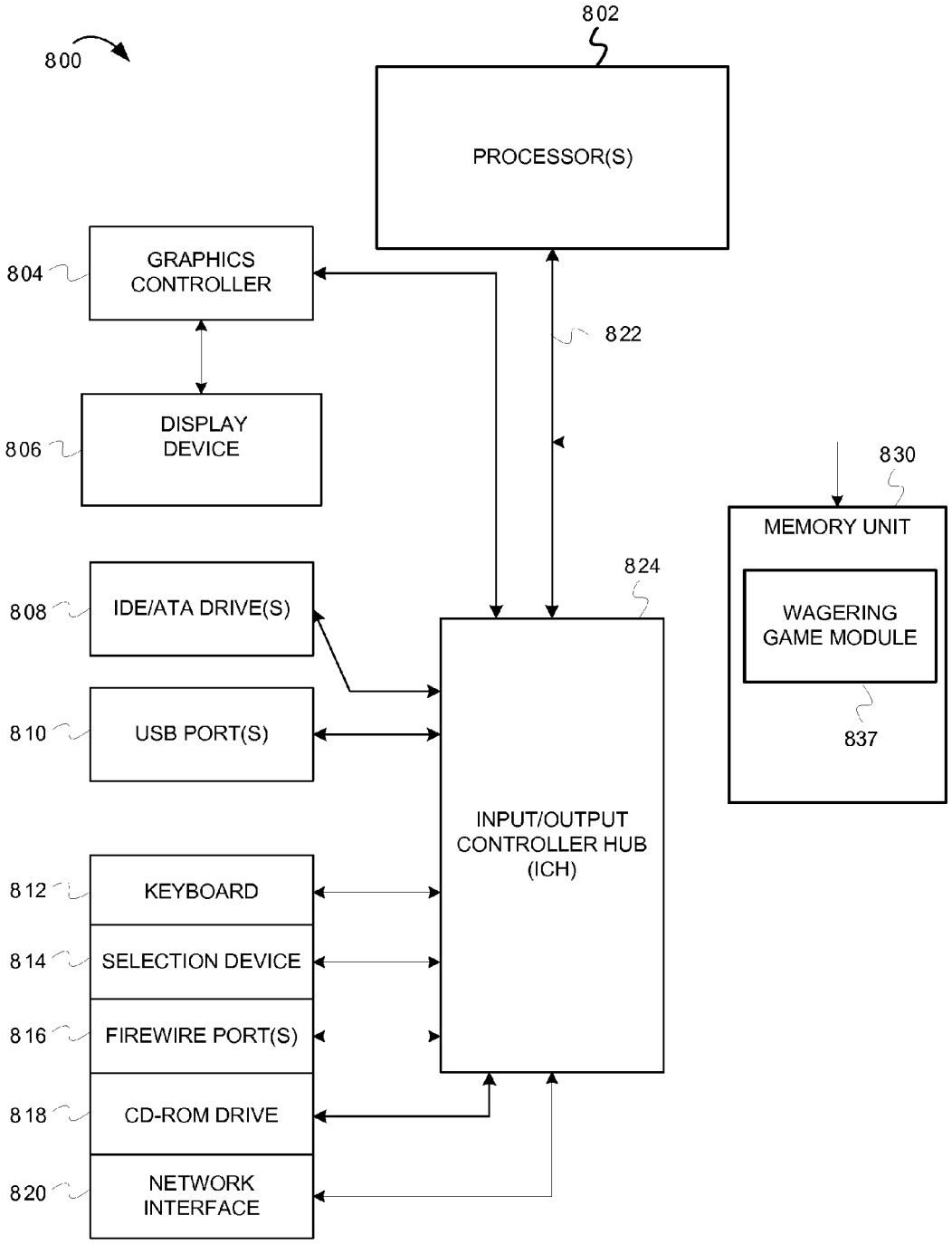
FIG. 8 is an illustration of a computer system 800, according to some embodiments.

FIG. 8 is a conceptual diagram that illustrates an example of a computer system 800, according to some embodiments. In FIG. 8, the computer system 800 may include a processor unit 802, a memory unit 830, a processor bus 822, and an Input/Output controller hub (ICH) 824. The processor unit 802, memory unit 830, and ICH 824 may be coupled to the processor bus 822. The processor unit 802 may comprise any suitable processor architecture. The computer system 800 may comprise one, two, three, or more processors, any of which may execute a set of instructions in accordance with some embodiments.

The memory unit 830 may also include an I/O scheduling policy unit 8 and I/O schedulers 8. The memory unit 830 can store data and/or instructions, and may comprise any suitable memory, such as a dynamic random access memory (DRAM), for example. The computer system 800 may also include one or more suitable integrated drive electronics (IDE) drive(s) 808 and/or other suitable storage devices. A graphics controller 804 controls the display of information on a display device 806, according to some embodiments.

The input/output controller hub (ICH) 824 provides an interface to I/O devices or peripheral components for the computer system 800. The ICH 824 may comprise any suitable interface controller to provide for any suitable communication link to the processor unit 802, memory unit 830 and/or to any suitable device or component in communication with the ICH 824. The ICH 824 can provide suitable arbitration and buffering for each interface.

For one embodiment, the ICH 824 provides an interface to the one or more IDE drives 808, such as a hard disk drive (HDD) or compact disc read only memory (CD ROM) drive, or to suitable universal serial bus (USB) devices through one or more USB ports 810. For one embodiment, the ICH 824 also provides an interface to a keyboard 812, selection device 814 (e.g., a mouse, trackball, touchpad, etc.), CD-ROM drive 818, and one or more suitable devices through one or more firewire ports 816. For one embodiment, the ICH 824 also provides a network interface 820 though which the computer system 800 can communicate with other computers and/or devices.

The computer system 800 may also include a machine-readable storage medium that stores a set of instructions (e.g., software) embodying any one, or all, of the methodologies for award achievements in wagering games. Furthermore, software can reside, completely or at least partially, within the memory unit 830 and/or within the processor unit 802. The computer system 800 can also include a wagering game module 837. The wagering game module 837 can process communications, commands, or other information, to award achievements in wagering games. Any component of the computer system 800 can be implemented as hardware, firmware, and/or machine-readable storage media including instructions for performing the operations described herein.

Wagering Game Machine Architecture

Figure 9:
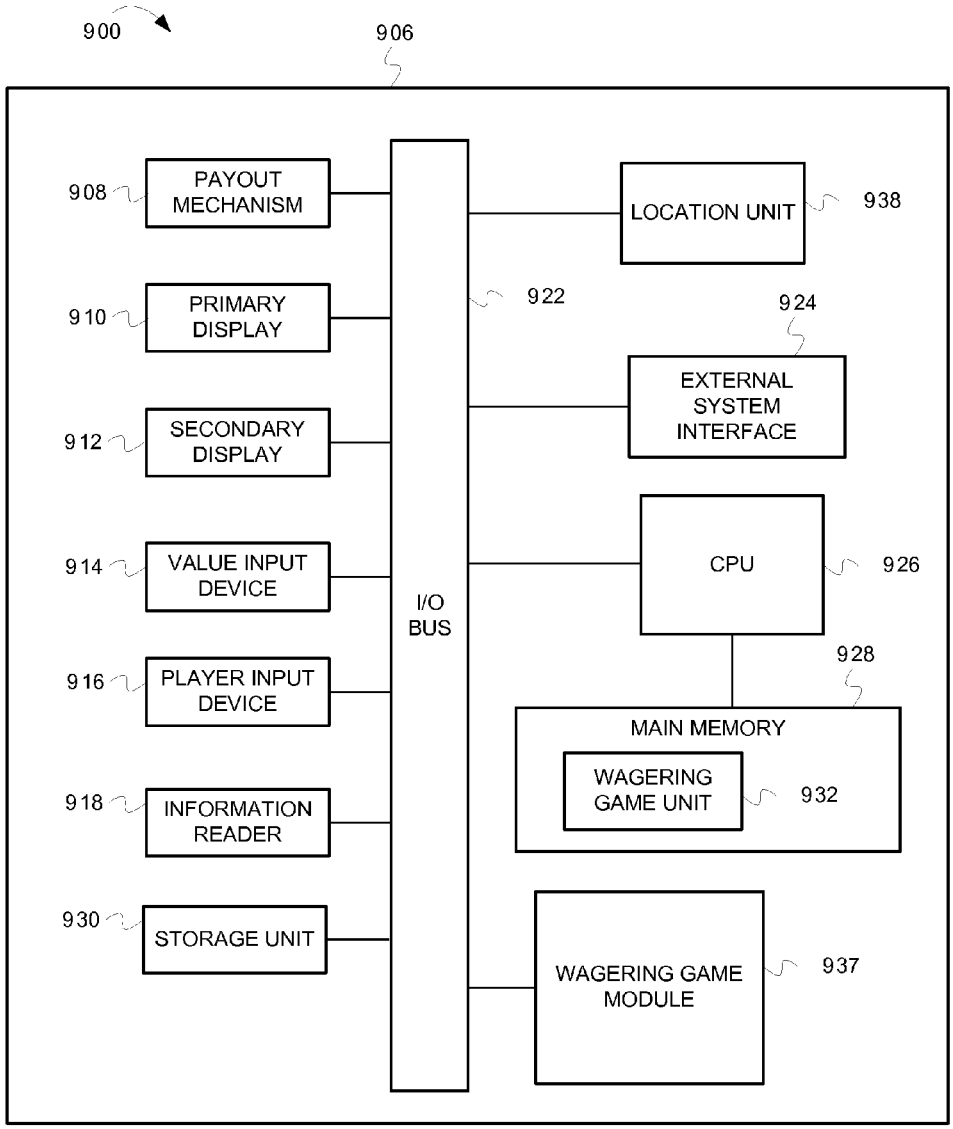
FIG. 9 is an illustration of a wagering game machine architecture 900, according to some embodiments.

FIG. 9 is a conceptual diagram that illustrates an example of a wagering game machine architecture 900, according to some embodiments. In FIG. 9, the wagering game machine architecture 900 includes a wagering game machine 906, which includes a central processing unit (CPU) 926 connected to main memory 928. The CPU 926 can include any suitable processor, such as an Intel® Pentium processor, Intel® Core 2 Duo processor, AMD Opteron™ processor, or UltraSPARC processor. The main memory 928 includes a wagering game unit 932. In some embodiments, the wagering game unit 932 can present wagering games, such as video poker, video black jack, video slots, video lottery, reel slots, etc., in whole or part.

The CPU 926 is also connected to an input/output ("I/O") bus 922, which can include any suitable bus technologies, such as an AGTL+frontside bus and a PCI backside bus. The I/O bus 922 is connected to a payout mechanism 908, primary display 910, secondary display 912, value input device 914, player input device 916, information reader 918, and storage unit 930. The player input device 916 can include the value input device 914 to the extent the player input device 916 is used to place wagers. The I/O bus 922 is also connected to an external system interface 924, which is connected to external systems (e.g., wagering game networks). The external system interface 924 can include logic for exchanging information over wired and wireless networks (e.g., 802.11g transceiver, Bluetooth transceiver, Ethernet transceiver, etc.)

The I/O bus 922 is also connected to a location unit 938. The location unit 938 can create player information that indicates the wagering game machine's location/movements in a casino. In some embodiments, the location unit 938 includes a global positioning system (GPS) receiver that can determine the wagering game machine's location using GPS satellites. In other embodiments, the location unit 938 can include a radio frequency identification (RFID) tag that can determine the wagering game machine's location using RFID readers positioned throughout a casino. Some embodiments can use GPS receiver and RFID tags in combination, while other embodiments can use other suitable methods for determining the wagering game machine's location. Although not shown in FIG. 9, in some embodiments, the location unit 938 is not connected to the I/O bus 922.

In some embodiments, the wagering game machine 906 can include additional peripheral devices and/or more than one of each component shown in FIG. 9. For example, in some embodiments, the wagering game machine 906 can include multiple external system interfaces 924 and/or multiple CPUs 926. In some embodiments, any of the components can be integrated or subdivided.

In some embodiments, the wagering game machine 906 includes a wagering game module 937. The wagering game module 937 can process communications, commands, or other information, where the processing can award achievements in wagering games.

Furthermore, any component of the wagering game machine 906 can include hardware, firmware, and/or machine-readable storage media including instructions for performing the operations described herein.

Mobile Wagering Game Machine

Figure 10:
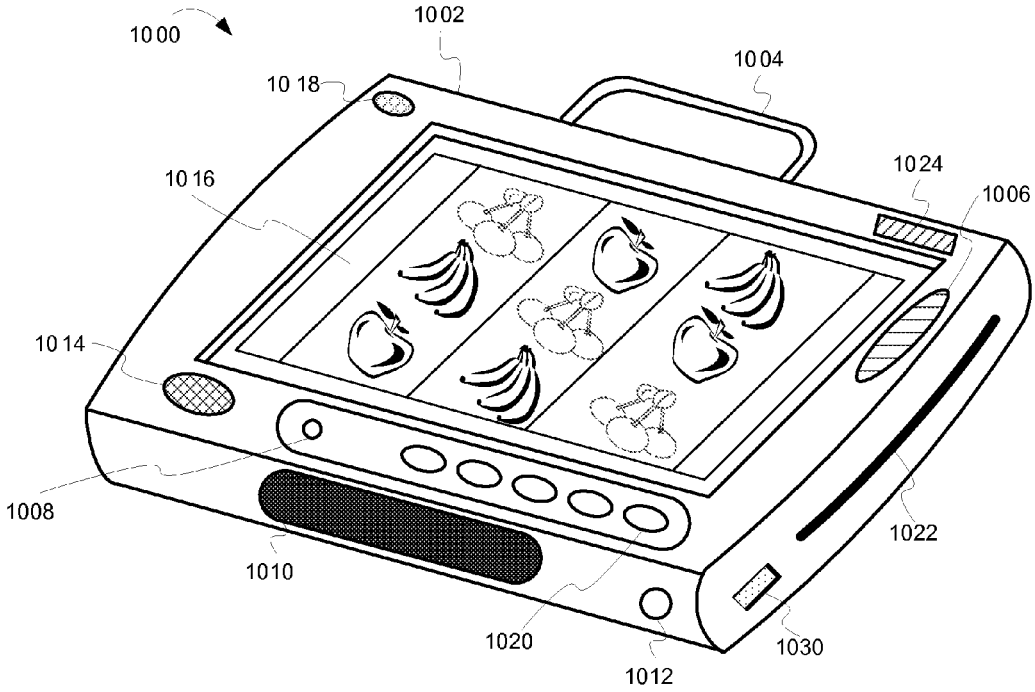
FIG. 10 is an illustration of a mobile wagering game machine 1000, according to some embodiments.

FIG. 10 is a conceptual diagram that illustrates an example of a mobile wagering game machine 1000, according to some embodiments. In FIG. 10, the mobile wagering game machine 1000 includes a housing 1002 for containing internal hardware and/or software such as that described above vis-à-vis FIG. 9. In some embodiments, the housing has a form factor similar to a tablet PC, while other embodiments have different form factors. For example, the mobile wagering game machine 1000 can exhibit smaller form factors, similar to those associated with personal digital assistants. In some embodiments, a handle 1004 is attached to the housing 1002. Additionally, the housing can store a foldout stand 1010, which can hold the mobile wagering game machine 1000 upright or semi-upright on a table or other flat surface.

The mobile wagering game machine 1000 includes several input/output devices. In particular, the mobile wagering game machine 1000 includes buttons 1020, audio jack 1008, speaker 1014, display 1016, biometric device 1006, wireless transmission devices (e.g., wireless communication units 1012 and 1024), microphone 1018, and card reader 1022. Additionally, the mobile wagering game machine can include tilt, orientation, ambient light, or other environmental sensors.

In some embodiments, the mobile wagering game machine 1000 uses the biometric device 1006 for authenticating players, whereas it uses the display 1016 and the speaker 1014 for presenting wagering game results and other information (e.g., credits, progressive jackpots, etc.). The mobile wagering game machine 1000 can also present audio through the audio jack 1008 or through a wireless link such as Bluetooth.

In some embodiments, the wireless communication unit 1012 can include infrared wireless communications technology for receiving wagering game content while docked in a wager gaming station. The wireless communication unit 1024 can include an 802.11G transceiver for connecting to and exchanging information with wireless access points. The wireless communication unit 1024 can include a Bluetooth transceiver for exchanging information with other Bluetooth enabled devices.

In some embodiments, the mobile wagering game machine 1000 is constructed from damage resistant materials, such as polymer plastics. Portions of the mobile wagering game machine 1000 can be constructed from non-porous plastics which exhibit antimicrobial qualities. Also, the mobile wagering game machine 1000 can be liquid resistant for easy cleaning and sanitization.

In some embodiments, the mobile wagering game machine 1000 can also include an input/output ("I/O") port 1030 for connecting directly to another device, such as to a peripheral device, a secondary mobile machine, etc. Furthermore, any component of the mobile wagering game machine 1000 can include hardware, firmware, and/or machine-readable storage media including instructions for performing the operations described herein.

Wagering Game Machine

Figure 11:
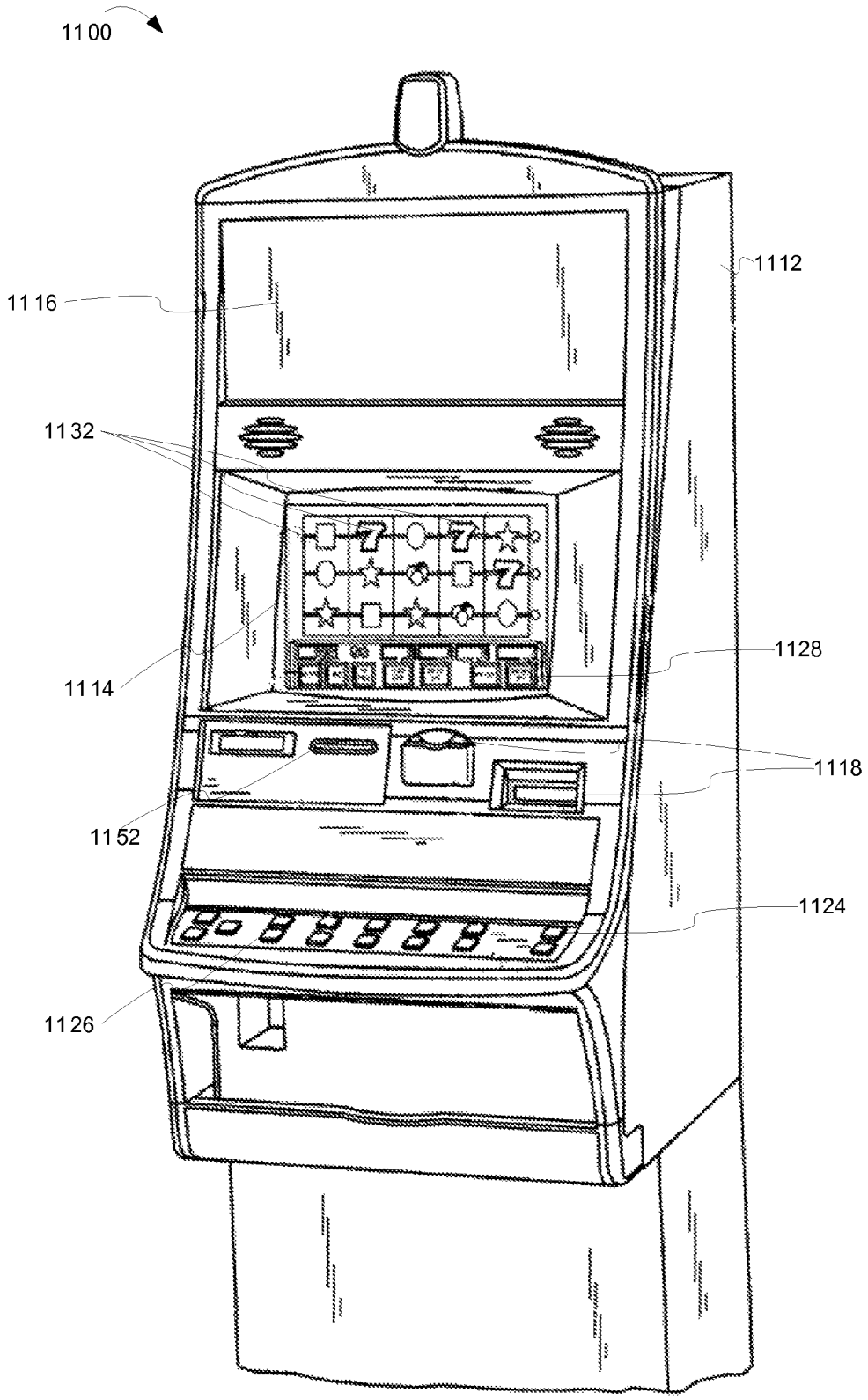
FIG. 11 is an illustration of a wagering game machine 1100, according to some embodiments.

FIG. 11 is a conceptual diagram that illustrates an example of a wagering game machine 1100, according to some embodiments. Referring to FIG. 11, the wagering game machine 1100 can be used in gaming establishments, such as casinos. According to some embodiments, the wagering game machine 1100 can be any type of wagering game machine and can have varying structures and methods of operation. For example, the wagering game machine 1100 can be an electromechanical wagering game machine configured to play mechanical slots, or it can be an electronic wagering game machine configured to play video casino games, such as blackjack, slots, keno, poker, blackjack, roulette, etc.

The wagering game machine 1100 comprises a housing 1112 and includes input devices, including value input devices 1118 and a player input device 1124. For output, the wagering game machine 1100 includes a primary display 1114 for displaying information about a basic wagering game. The primary display 1114 can also display information about a bonus wagering game and a progressive wagering game. The wagering game machine 1100 also includes a secondary display 1116 for displaying wagering game events, wagering game outcomes, and/or signage information. While some components of the wagering game machine 1100 are described herein, numerous other elements can exist and can be used in any number or combination to create varying forms of the wagering game machine 1100.

The value input devices 1118 can take any suitable form and can be located on the front of the housing 1112. The value input devices 1118 can receive currency and/or credits inserted by a player. The value input devices 1118 can include coin acceptors for receiving coin currency and bill acceptors for receiving paper currency. Furthermore, the value input devices 1118 can include ticket readers or barcode scanners for reading information stored on vouchers, cards, or other tangible portable storage devices. The vouchers or cards can authorize access to central accounts, which can transfer money to the wagering game machine 1100.

The player input device 1124 comprises a plurality of push buttons on a button panel 1126 for operating the wagering game machine 1100. In addition, or alternatively, the player input device 1124 can comprise a touch screen 1128 mounted over the primary display 1114 and/or secondary display 1116.

The various components of the wagering game machine 1100 can be connected directly to, or contained within, the housing 1112. Alternatively, some of the wagering game machine's components can be located outside of the housing 1112, while being communicatively coupled with the wagering game machine 1100 using any suitable wired or wireless communication technology.

The operation of the basic wagering game can be displayed to the player on the primary display 1114. The primary display 1114 can also display a bonus game associated with the basic wagering game. The primary display 1114 can include a cathode ray tube (CRT), a high resolution liquid crystal display (LCD), a plasma display, light emitting diodes (LEDs), or any other type of display suitable for use in the wagering game machine 1100. Alternatively, the primary display 1114 can include a number of mechanical reels to display the outcome. In FIG. 11, the wagering game machine 1100 is an "upright" version in which the primary display 1114 is oriented vertically relative to the player. Alternatively, the wagering game machine can be a "slant-top" version in which the primary display 1114 is slanted at about a thirty-degree angle toward the player of the wagering game machine 1100. In yet another embodiment, the wagering game machine 1100 can exhibit any suitable form factor, such as a free standing model, bar top model, mobile handheld model, or workstation console model.

A player begins playing a basic wagering game by making a wager via the value input device 1118. The player can initiate play by using the player input device's buttons or touch screen 1128. The basic game can include arranging a plurality of symbols along a pay line 1132, which indicates one or more outcomes of the basic game. Such outcomes can be randomly selected in response to player input. At least one of the outcomes, which can include any variation or combination of symbols, can trigger a bonus game.

In some embodiments, the wagering game machine 1100 can also include an information reader 1152, which can include a card reader, ticket reader, bar code scanner, RFID transceiver, or computer readable storage medium interface. In some embodiments, the information reader 1152 can be used to award complimentary services, restore game assets, track player habits, etc.

The described embodiments may be provided as a computer program product, or software, that may include a machine-readable storage medium having stored thereon instructions, which may be used to program a computer system (or other electronic device(s)) to perform a process according to embodiments(s), whether presently described or not, because every conceivable variation is not enumerated herein. A machine readable storage medium includes any mechanism for storing and transmitting information in a form (e.g., software, processing application) readable by a machine (e.g., a computer). The machine-readable storage medium may include, but is not limited to, magnetic storage medium (e.g., floppy diskette); optical storage medium (e.g., CD-ROM); magneto-optical storage medium; read only memory (ROM); random access memory (RAM); erasable programmable memory (e.g., EPROM and EEPROM); flash memory; or other types of medium suitable for storing electronic instructions.

General

This detailed description refers to specific examples in the drawings and illustrations. These examples are described in sufficient detail to enable those skilled in the art to practice the inventive subject matter. These examples also serve to illustrate how the inventive subject matter can be applied to various purposes or embodiments. Other embodiments are included within the inventive subject matter, as logical, mechanical, electrical, and other changes can be made to the example embodiments described herein. Features of various embodiments described herein, however essential to the example embodiments in which they are incorporated, do not limit the inventive subject matter as a whole, and any reference to the invention, its elements, operation, and application are not limiting as a whole, but serve only to define these example embodiments. This detailed description does not, therefore, limit embodiments, which are defined only by the appended claims. Each of the embodiments described herein are contemplated as falling within the inventive subject matter, which is set forth in the following claims.

The invention claimed is:

1. A computer-implemented method comprising:

displaying a first list during a feature game, wherein the first list is displayed via at least one processor on a display device of a wagering game machine, wherein the first list specifies a plurality of wagering game events that can potentially occur during one or more wagering games available via the wagering game machine, wherein the displaying of the first list occurs prior to occurrence of at least one of the plurality of wagering game events in the first list;

displaying a second list on the display device via the at least one processor, wherein the second list specifies a plurality of awards ordered in a sequential order of award values, wherein the plurality of awards are potentially awardable during the feature game, and wherein at least one of the plurality of awards has not yet been awarded since initiation of the feature game;

detecting occurrence of one of the plurality of wagering game events specified in the first list in response to user input during the one or more wagering games;

selecting, in response to the detecting, one of the plurality of awards, wherein the one of the plurality of awards has not yet been awarded since the initiation of the feature game, and wherein the one of the plurality of awards is lowest in value in the sequential order of award values specified in the second list; and awarding the one of the plurality of awards for the feature game.

2. The computer-implemented method of claim 1, wherein the one of the plurality of wagering game events has a first probability of occurrence during the one or more wagering games different from at least one other probability of occurrence for at least one other of the plurality of wagering game events, and wherein the selecting of the one of the plurality of awards is independent of a value for the first probability.

3. The computer-implemented method of claim 1 further comprising:

indicating, via the display, a probable number of times that the each of the plurality of wagering game events is likely to occur in a given number of plays of the one or more wagering games; and indicating, via the display, an actual number of plays that have occurred since the initiation of the feature game.

4. The computer-implemented method of claim 1 further comprising:

indicating, via the first list, that the one of the plurality of wagering game events occurred;

indicating, via the second list, that the one of the plurality of awards has been awarded and is unavailable;

storing a state for the first list and the second list during a first wagering game session; and presenting the first list and the second list on the display during a second wagering game session conducted via the wagering game machine, according to the state for the first list and the second list stored during the first wagering game session.

5. The computer-implemented method of claim 1 further comprising:

determining player preferences for award types;

selecting the plurality of awards based on the award types;

determining player preference ratings for the award types; and generating the sequential order of award values of the plurality of awards on the second list based on the player preference ratings.

6. The computer-implemented method of claim 1 further comprising:

initiating the one or more wagering games prior to detecting the one of the plurality of wagering game events;

presenting, via the display, a control to select between a plurality of lists associated with the feature game;

detecting a selection of the control;

determining, in response to the selection of the control, that the first list indicates the one of the plurality of wagering game events and that the one of the plurality of wagering game events has not yet occurred since the initiation of the feature game; and selecting the first list and the second list from the plurality of lists, in response to the determining that the first list indicates the one of the plurality of wagering game events and that the one of the plurality of wagering game events has not yet occurred since the initiation of the feature game.

7. The computer-implemented method of claim 1 further comprising:

awarding additional ones of the plurality of awards, in ascending order of value, for successive occurrences of a remainder of the plurality of wagering game events specified in the first list;

determining that all of the plurality of awards have been awarded; and reinitiating the feature game.

8. The computer-implemented method of claim 1, wherein the plurality of wagering game events comprise occurrences in the one or more wagering games of one or more of arrangements of wagering game playing elements, appearances of specific items, and sequences of activities.

9. One or more tangible machine-readable storage media having instructions stored thereon, which when executed by a set of one or more processors causes the set of one or more processors to perform operations comprising:

initiating a feature game, wherein the feature game uses a first list and a second list;

presenting the first list via a display of a wagering game machine, wherein the first list specifies a plurality of wagering game events that can potentially occur from wagering games playable via the wagering game machine, wherein the presenting of the first list occurs prior to occurrence of at least one of the plurality of wagering game events in the first list, and wherein one of the plurality of wagering game events has a first probability of occurrence different from a second probability of occurrence of an additional one of the plurality of wagering game events during the wagering games;

presenting the second list via the display, wherein the second list specifies a plurality of awards, in a sequential order of award values, wherein the plurality of awards are potentially obtainable via the feature game;

determining an occurrence of the one of the plurality of wagering game events specified in the first list, in response to user input, for at least one of the wagering games;

determining that the one of the plurality of wagering game events is eligible for the feature game;

selecting one of the plurality of awards that has a lowest value in the sequential order of award values and which has not yet been awarded since initiation of the feature game, wherein the selecting of the one of the plurality of awards is in response to the determining that the one of the plurality of wagering game events is eligible for the feature game, and wherein the selecting of the one of the plurality of awards is independent of the first probability of occurrence associated with the one of the plurality of wagering game events; and awarding at least a portion of the one of the plurality of awards, for the feature game, in response to the occurrence of the one of the plurality of wagering game events.

10. The one or more tangible machine-readable storage media of claim 9, said operation of determining that the one of the plurality of wagering game events is eligible for the feature game comprises, determining that the one of the plurality of wagering game events has not already occurred since initiation of the feature game.

11. The one or more tangible machine-readable storage media of claim 9, said operations further comprising:

indicating, via the second list, that the one of the plurality of awards was awarded for the feature game.

12. The one or more tangible machine-readable storage media of claim 9, said operations further comprising:

indicating, via the display, a probable number of times that the each of the plurality of wagering game events is likely to occur in a given number of plays of the wagering games; and indicating, via the display, an actual number of plays that have occurred for the wagering games since initiation of the feature game.

13. The one or more tangible machine-readable storage media of claim 9, said operations further comprising:

indicating, via the first list, that the one of the plurality of wagering game events occurred;

indicating, via the second list, that the one of the plurality of awards has been awarded and is unavailable;

storing a state for the first list and the second list during a first wagering game session; and presenting the first list and second list on the display during a second wagering game session conducted via the wagering game machine, according to the state for the first list and the second list stored during the first wagering game session.

14. The one or more tangible machine-readable storage media of claim 9, said operation of awarding the at least a portion of the one of the plurality of awards comprises, determining an award division setting for multiple player accounts, wherein the award division setting specifies a division of possession rights to the one of the plurality of awards; and dividing the one of the plurality of awards according to the award division setting.

15. The one or more tangible machine-readable storage media of claim 9, said operations further comprising:

presenting a picker grid, after detection the one of the plurality of wagering game events and prior to the one of the plurality of awards being awarded, wherein the picker grid distributes portions of the one of the plurality of awards throughout the picker grid.

16. A system comprising:

a client comprising, a wagering game module configured to present a wagering game, wherein the wagering game is configured with a plurality of wagering game events that can potentially occur during the wagering game, present an award list associated with a secondary game, wherein the award list presents a plurality of awards in a sequential order of award values that are attainable via the secondary game, and present an event list associated with the secondary game, wherein the event list presents at least some of the plurality of wagering game events that can occur during the wagering game, and wherein the at least some of the plurality of wagering game events have varying probabilities of occurrence during the wagering game; and a wagering game server comprising, a secondary game controller configured to initiate the secondary game, detect player input for the wagering game during a wagering game session, determine an occurrence of one wagering game event, from the at least some of the plurality of wagering game events, in response to the player input, determine that the one wagering game event has not occurred via play of the wagering game since initiation of the secondary game, determine a portion of the plurality of awards that are unawarded since the initiation of the secondary game, select one of the plurality of awards that is next in an ascending sequence of the sequential order of award values, and award at least a portion of the one of the plurality of awards.

17. The system of claim 16, wherein the wagering game module is further configured to indicate a probable number of times that the each of the at least some of the plurality of wagering game events is likely to occur in a given number of plays of the wagering game, and indicate an actual number of plays that have occurred for the wagering game since the initiation of the secondary game.

18. The system of claim 16, wherein the wagering game module is further configured to indicate, via the first list, that the one wagering game event occurred, and indicate, via the second list, that the one of the plurality of awards has been awarded and is unavailable.

19. The system of claim 16, wherein the secondary game controller is further configured to initiate the wagering game prior to detecting that the one wagering game event occurred, present, via the display, a control to select between a plurality of lists associated with the secondary game, detect a selection of the control, determine, in response to the selection of the control, that the first list includes at least one of the at least some of the plurality of wagering game events and that the at least one of the at least some of the plurality of wagering game events has not yet occurred since the initiation of the secondary game, and present the first list and the second list, in response to determination that the first list includes the at least one of the at least some of the plurality of wagering game events and that the at least one of the at least some of the plurality of wagering game events has not yet occurred since the initiation of the secondary game.

20. An apparatus comprising:

a processor; and a wagering game module configured to, via the processor, present a first list, associated with a feature game, via a display of a wagering game machine, wherein the first list specifies a plurality of wagering game events that can potentially occur from a plurality of wagering games playable via the wagering game machine, present a second list, associated with the feature game, via the display, wherein the second list specifies a plurality of awards, in a sequential order of award values, wherein the plurality of awards are potentially obtainable via the feature game, initiate one of the plurality of wagering games during a wagering game session conducted via the wagering game machine, determine an occurrence of one of the plurality of wagering game events specified in the first list, in response to user input, for the one of the plurality of wagering games, determine that the one of the plurality of wagering game events is eligible for the feature game, select one of the plurality of awards that has a lowest value in the sequential order of award values and which has not yet been awarded for the feature game, and present an activity to perform to win at least a portion of the one of the plurality of awards for the feature game, in response to the occurrence of the one of the plurality of wagering game events.

21. The apparatus of claim 20, wherein the first list specifies probabilities of occurrence for the plurality of wagering game events from the plurality of wagering games, and wherein the one of the plurality of awards is selected independently of one of the probabilities of occurrence for the one of the plurality of wagering game events specified in the first list.

22. The apparatus of claim 20, wherein the wagering game module is further configured to generate a picker-grid that includes a number of picking items, wherein the number of picking items correlates with one or more betting settings of the one of the plurality of wagering games, present the picker-grid as the secondary game activity, determine a winning selection of at least one of the picking items that reveals at least a portion of the one of the plurality of awards, and award the at least a portion of the one of the plurality of awards.

23. An apparatus comprising:

means for initiating a feature game, wherein the feature game is associated with a first list and a second list;

means for displaying the first list on a display associated with a wagering game machine, wherein the first list specifies a plurality of wagering game events that can potentially occur during one or more wagering games available via the wagering game machine via a plurality of wagering game sessions, wherein the displaying of the first list occurs prior to occurrence of at least one of the plurality of wagering game events in the first list;

means for displaying the second list on the display, wherein the second list specifies a plurality of awards that are awardable, during the feature game, in a sequential order of award values;

means for detecting occurrence of one of the plurality of the wagering game events specified in the first list in response to user input during the one or more wagering games;

means for determining a portion of the plurality of awards that have not yet been awarded since initiation of the feature game;

means for selecting one award, from the portion of the plurality of awards, that is lowest in value of the sequential order of award values, wherein the one of the plurality of wagering game events has a first probability of occurrence during the one or more wagering games different from a second probability of occurrence for at least one other of the plurality of wagering game events, and wherein the selecting of the one of the plurality of awards is independent of a value for the first probability of occurrence; and means for awarding the one award, for the feature game, in response to the occurrence of the one of the plurality of the wagering game events.

24. The apparatus of claim 23 further comprising:

means for dividing the one award according to an award division setting that specifies a division of possession rights to the one award by a group of wagering game player accounts.

25. The apparatus of claim 23 further comprising:

means for determining, prior to displaying the first list and the second list, that any of the plurality of wagering game events have not yet occurred since initiation of the feature game via play of the one or more wagering games via the wagering game machine.

* * * * *